US012636691B2

(12) United States Patent
Duhoux et al.

(10) Patent No.: US 12,636,691 B2
(45) **Date of Patent: *May 26, 2026**

(54) METHOD AND EQUIPMENT FOR COOLING ON A REVERSING HOT ROLLING MILL

(71) Applicants: CONSTELLIUM NEUF-BRISACH, Biesheim (FR); CONSTELLIUM MUSCLE SHOALS LLC, Muscle Shoals, AL (US)

(72) Inventors: Vincent Duhoux, Coublevie (FR); Gilles Guiglionda, Seyssinet-pariset (FR); Romain-Fabrice Bernes, Issoire (FR); Bruno Magnin, Saint-Aupre (FR); Erin Deda, Ypsilanti, MI (US); Xavier Unterfinger, Colmar (FR); John M. Evans, Muscle Shoals, AL (US); Trevor Gilmore, Waterloo, AL (US)

(73) Assignees: CONSTELLIUM NEUF-BRISACH, Biesheim (FR); CONSTELLIUM MUSCLE SHOALS LLC, Muscle Shoals, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/828,850

(22) Filed: Sep. 9, 2024

(65) Prior Publication Data

US 2024/0424541 A1 Dec. 26, 2024

Related U.S. Application Data

(62) Division of application No. 18/000,449, filed as application No. PCT/FR2021/051002 on Jun. 2, 2021, now Pat. No. 12,128,463.

(Continued)

(30) Foreign Application Priority Data

Jul. 7, 2020 (FR) ..... 2007191
Nov. 26, 2020 (FR) ..... 2012174

(51) Int. Cl.
*B21B 1/34* (2006.01)
*B21B 3/00* (2006.01)

(Continued)

(52) U.S. Cl.
CPC ..... *B21B 1/34* (2013.01); *B21B 3/00* (2013.01); *B21B 37/44* (2013.01);

(Continued)

(58) Field of Classification Search
CPC ..... B21B 1/34; B21B 37/44; B21B 45/0203; B21B 37/74; B21B 2003/001; B21B 3/00
See application file for complete search history.

(56) References Cited

U.S. PATENT DOCUMENTS 4,204,880 A 5/1980 Monreal et al.
4,658,363 A 4/1987 Tippins et al.

(Continued)

FOREIGN PATENT DOCUMENTS

DE 102012223848 A1 6/2014
DE 102013221710 A1 4/2015

(Continued)

OTHER PUBLICATIONS

International Search Report of International Patent Application No. PCT/FR2021/051002, mailed Oct. 1, 2021.

(Continued)

*Primary Examiner* — Ryan J. Walters
(74) *Attorney, Agent, or Firm* — McBee Moore & Vanik, IP, LLC

(57) ABSTRACT

The invention relates to a hot reversing mill equipped with one or more cooling systems consisting of bars of nozzles (Continued)

spraying an aluminum blank. It also relates to the hot rolling process associated with this hot reversing mill wherein the cooling system serves at least once making it possible to produce aluminum sheets advantageously. It also relates to the process for rolling an AA6xxx series aluminum alloy wherein a blank is cooled during the hot rolling and a sheet obtained with this process. The invention makes it possible to enhance the productivity of reversing mills by enhancing the metallurgical quality and/or the productivity of the other fabrication steps. The invention is particularly useful for providing superior quality 6xxx alloy sheets intended for the automotive industry.

8 Claims, 28 Drawing Sheets
(7 of 28 Drawing Sheet(s) Filed in Color)

Related U.S. Application Data

(60) Provisional application No. 63/034,845, filed on Jun. 4, 2020.

(51) Int. Cl.
*B21B 37/44* (2006.01)
*B21B 45/02* (2006.01)
*B21B 37/74* (2006.01)

(52) U.S. Cl.
CPC .... *B21B 45/0203* (2013.01); *B21B 2003/001* (2013.01); *B21B 37/74* (2013.01)

(56) References Cited

U.S. PATENT DOCUMENTS

| | | | |
|---|---|---|---|
| 6,309,482 | B1 | 10/2001 | Dorricott et al. |
| 8,434,338 | B2 | 5/2013 | Armenat et al. |
| 9,643,224 | B2 | 5/2017 | Breuer et al. |
| 9,833,823 | B2 | 12/2017 | Sprock et al. |
| 10,130,980 | B2 | 11/2018 | Duhoux et al. |
| 10,384,248 | B2 | 8/2019 | Breuer et al. |
| 11,053,576 | B2 | 7/2021 | Yamamoto et al. |
| 12,128,463 | B2 * | 10/2024 | Duhoux ..... B21B 45/0203 |
| 2016/0020115 | A1 | 1/2016 | Demichi et al. |
| 2018/0236514 | A1 | 8/2018 | Duhoux et al. |
| 2019/0153577 | A1 | 5/2019 | Guiglionda et al. |
| 2020/0239991 | A1 | 7/2020 | Yamamoto et al. |

FOREIGN PATENT DOCUMENTS

| | | | |
|---|---|---|---|
| EP | 0542640 | A1 | 5/1993 |
| EP | 0786535 | A1 | 7/1997 |
| EP | 1165851 | A1 | 1/2002 |
| EP | 1375691 | A1 | 1/2004 |
| EP | 1925373 | B1 | 3/2010 |
| EP | 2979769 | A1 | 2/2016 |
| EP | 2991783 | A1 | 3/2016 |
| FR | 2378579 | A1 | 8/1978 |
| JP | 2015067857 | A | 4/2015 |
| JP | 2015091604 | A | 5/2015 |
| WO | 2008/89827 | A1 | 7/2008 |
| WO | 2015/058902 | A1 | 4/2015 |
| WO | 2016/012691 | A1 | 1/2016 |
| WO | 2018/011245 | A1 | 1/2018 |
| WO | 2019/241514 | A1 | 12/2019 |

OTHER PUBLICATIONS

French Search Report of French Application No. 200719, dated Mar. 22, 2021.

Patrick Deneuville, "Mise en forme de l'aluminium—Laminage", Techniques de l'Ingenieur, 2010—English Abstract.

* cited by examiner

METHOD AND EQUIPMENT FOR COOLING ON A REVERSING HOT ROLLING MILL

CROSS REFERENCE TO RELATED APPLICATIONS

This application is a divisional of U.S. patent application Ser. No. 18/000,449, filed on 1 Dec. 2022, which is a National Stage entry of International Application No. PCT/FR2021/051002, filed on 2 Jun. 2021, which claims priority to U.S. Patent Application No. 63/034,845, filed on 4 Jun. 2020, French Patent Application No. FR2007191, filed on 7 Jul. 2020, and French Patent Application No. FR2012174, filed on 26 Nov. 2020. Each of these applications is incorporated by reference in its entirety.

BACKGROUND

The invention relates to the field of rolling flat aluminum alloy products. More specifically, the invention relates to a hot reversing mill equipped with a particularly rapid, homogeneous, and reproducible cooling system for flat aluminum alloy products.

The invention also relates to a process executed by said hot reversing mill equipped with a cooling system enabling a better thermal control of the flat aluminum alloy products during rolling. The invention also relates to a sheet, the process whereof uses a cooling during hot rolling, which can be obtained with the invention.

Description of Related Art

A hot line for rolling aluminum alloys always includes a reversing mill (i.e. two-way rolling) also known as a roughing mill or blooming train and, optionally, a multi-cage mill also known as tandem mill, at the output whereof the still hot metal is rolled up. The number of passes and the stepover (reduction in thickness per pass) are dependent on the hardness of the product (the flow stress thereof) and obviously, on the power of the mill, in terms of torque and load. Productivity requires taking the greatest possible reductions at each pass. However, one is then limited by the capacity of the mill in terms of rolling load and/or rolling torque, as described for example in the article "Mise en forme de l'aluminium—Laminage—Patrick Deneuville, © Techniques de l'Ingénieur—2010". During hot aluminum fabrications such as hot rolling, the temperature of the metal is always at least typically 200° C.

Hot lines are moreover known wherein two reversing mills succeed each other followed by a tandem mill.

Hot reversing mills are frequently production bottlenecks in factories and in the light of the considerable investments that they represent, increasing the productivity thereof is a major challenge and obviously it has always been sought to increase the capacity of the mill in terms of mill load and/or torque.

In the prior art, it has frequently been envisaged to enhance the productivity of tandem mills rather than that of the reversing mill. The applications hereinafter particularly relate to cooling methods or processes installed on finish rolling hot tandem mills.

The patent application WO201558902 relates to a table for hot rolling aluminum strips and a process for hot rolling an aluminum strip.

The aim of this application is that of proposing, for a table for hot rolling aluminum strips comprising a tandem finish rolling table with several cages including at least one reel mounted downstream in the rolling direction and at least one associated cooling section, a solution which makes it possible to adjust in the best way the cooling curves and the temperature-time trajectories in the product to be rolled during hot rolling of aluminum strips. For this purpose, the cooling section(s) are arranged in the output zone of the table for hot rolling aluminum strips, and at least one trimming shears installed downstream in the rolling direction is associated with the tandem finish rolling table.

The patent EP2991783 relates to a process for manufacturing a metallic strip. This patent relates to a process for manufacturing a metallic strip whereby the strip is rolled in a mill with several cages, is output behind the last cage of the mill in the direction of transportation and cooled in a cooling device. To obtain a favorable granular structure and a high degree of flatness, according to the patent, the strip or sheet is subjected directly after passing through the work rolls of the last mill cage to an additional rapid cooling, the cooling of the strip or sheet still taking place at least in part in the span of the last mill cage in the direction of transportation, the rapid cooling taking place by applying a cooling fluid via the top and via the bottom on the strip or sheet, the volume flow of cooling fluid applied via the bottom on the strip or sheet amounting at least to 120% of the volume flow of cooling fluid applied via the top on the strip or sheet.

The patent application WO200889827 relates to a device for cooling a metallic strip. This application relates to a device for cooling a metallic strip between two mill cages, the strip being guided on a top guiding element of planar design. Below the top guiding element is disposed a prilling element which drives cooling fluid through at least one opening in the top guiding element towards the bottom side of the strip. In order to obtain an enhanced prilling design, according to this application, at least two openings juxtaposed in the transversal direction to the feed direction of the strip are produced in the top guiding element and have an elongated shape. The longitudinal axis of the opening is oriented along an angle with respect to the feed direction of the strip.

Processes and equipment also exist for cooling slabs before starting to supply the hot mill.

The patent application WO2016/012691 relates to a cooling process and equipment. This application relates to a process for cooling an aluminum alloy rolling slab, after the metallurgical homogenizing heat treatment of said slab and prior to the hot rolling thereof, characterized in that the cooling by a value of 30 to 150° C. is performed at a rate of 150 to 500° C./h, with a homogeneity of less than 40° C. on the entire treated part of the slab. This application also relates to the installation for executing said process as well as said execution.

The patent application WO 2018/011245 relates to a process for manufacturing a 6xxx series aluminum alloy sheet comprising the following steps: casting a 6xxx series aluminum alloy to form an ingot; homogenizing the ingot; cooling the homogenized ingot at a cooling rate of at least 150° C./h directly to the hot rolling starting temperature; hot rolling the ingot to a final thickness and coiling at the final thickness after hot rolling under conditions making it possible to obtain a recrystallization rate of at least 50%; cold rolling so as to obtain a cold-rolled sheet. The process according to the invention is particularly useful for manufacturing sheets intended for the automotive industry which combine a high tensile yield strength and a formability suitable for cold drawing operations, as well as an excellent surface quality and a high corrosion resistance with a high productivity.

For 6000 series alloys, further modifications are also envisaged to enhance the productivity and/or metallurgical properties.

The patent application EP1165851 relates to a process for converting an ingot of a 6000 series aluminum alloy into a self-annealing foil. This process consists of subjecting the ingot to a homogenizing heat treatment in two steps, firstly at a temperature of at least 560° C., then at a temperature between 450° C. and 480° C. This process then consists of hot rolling the homogenized ingot at a starting temperature between 450° C. and 480° C., then at an arrival temperature between 320° C. and 360° C. A hot-rolled foil comprising an exceptionally low Cube recrystallization component is thus obtained.

The patent application US2016/0201158 relates to novel processes for increasing the productivity on a continuous annealing and solution heat treatment line for aluminum sheet products for the automotive industry suitable for a heat treatment having high T4 and post-curing strength and reduced roping. By way of non-limiting example, the processes according to the invention can be used in the automotive industry. The alloys suitable for a heat treatment and the processes according to the invention can also be applied in the maritime, aerospace, and transportation industries.

The patent application EP1375691 relates to rolled foil made of type 6000 aluminum alloy containing Si and Mg as main constituents and having an excellent formability sufficient for enabling flat flap machining, an excellent dent resistance, and a good hardening ability during curing of a coating. The alloy foil has an anisotropy with a Lankford coefficient greater than 0.4 or a resistance coefficient for cubic texture orientations greater than or equal to 20, and has a critical radius of curvature less than or equal to 0.5 mm at 180° C., even bending when the resistance at the conventional flow threshold exceeds 140 MPa by ageing at ambient temperature. The invention also relates to a process for producing rolled aluminum alloy foil, which consists of subjecting an ingot to a homogenizing treatment, cooling same to a temperature less than 350° C. at a cooling rate of 100° C./hour or more, optionally to ambient temperature, heating same once again to a temperature from 300 to 500° C. and subjecting same to a hot rolling, performing a cold rolling of the hot-rolled product, and subjecting the cold-rolled foil to a solution treatment at a temperature greater than or equal to 400° C. before performing a quenching.

The application EP0786535 relates to the homogenizing, at a temperature not less than 500° C., of an aluminum alloy ingot containing not less than 0.4% by weight and less than 1.7% by weight of Si, not less than 0.2% by weight and less than 1.2% by weight of Mg, as well as Al and unavoidable impurities by way of remainder, then the product obtained is cooled from a temperature not less than 500° C. to a temperature located in the range between 350 and 450° C., and the starting point whereof enables a hot rolling. The hot rolling step being completed at a temperature situated in the range between 200 and 300° C., the product obtained is subjected to a cold rolling at a reduction ratio not less than 50%, immediately prior to the solution treatment thereof. The cold-rolled product is then subjected to a solution treatment wherein it is kept at a temperature found in the range located between 500 and 580° C., at a temperature rise rate of not less than 2° C./s for at most 10 minutes, then the product obtain is subjected to a hardening during which it is cooled to a temperature not greater than 100° C., at a cooling rate not less than 5° C./s. A process is thus obtained for producing an aluminum alloy rolling ingot intended for a molding, which has a high strength and moldability, as well as an excellent external appearance on the post-molding surface thereof, which is used appropriately as a material intended for transport equipment parts, such as external rolling ingots for automobiles.

The patent application JP2015067857 relates to the provision of an excellent Al—Mg—Si-based aluminum alloy foil for automobile panel in terms of drawability, suitable for bending capable of processing flat bending, a shape stability property, hardening of coating galling and corrosion resistance, and providing a manufacturing method for this purpose, where an Al—Mg—Si-based aluminum alloy foil for automobile panel containing Si: 0.4 to 1.5%, Mg: 0.2 to 1.2%, Cu: 0.001 to 1.0%, Zn: 0.5% or less, Ti: 0.1% or less, B: 50 ppm or less, one or more types of Mn: 0.30% or less, Cr: 0.20% or less, and Zr: 0.15% or less, and the remainder Al with unavoidable impurities. A distribution of the density of the direction of the cube to a part of the depth of ¼ of the thickness of the foil from a surface is within a range of 10 to 25, a mean of the value r ($r=(r+r+r\times2)/4$) is 0.50 or furthermore, an absolute value of an anisotropy index in the place of the value r $\Delta r$ ($\Delta r=(r+rr\times2)/2$) is 0.30 or less and a mean crystal particle diameter is 50 μm or less.

For metallurgical or productivity reasons, it can be envisaged to quench the strip after hot rolling.

A reversing mill followed by a "tank" wherein the metal at the final thickness is immersed to be cooled is known ("Mise en forme de l'aluminium—Laminage—Patrick Deneuville, © Techniques de l'Ingénieur—2010").

The patent application WO2019241514 relates to systems and processes for quenching a metallic strip after rolling. This application relates to systems and processes for quenching a metallic substrate, comprising the cooling of a top surface and a bottom surface of the metallic substrate until a strip temperature is cooled to an intermediate temperature. The cooling of the top surface of the metallic substrate is interrupted when the strip temperature reaches the intermediate temperature, and the cooling of the bottom surface of the metallic substrate continues until the metallic substrate reaches a target temperature, the target temperature being less than the intermediate temperature.

Patent application FR2378579 relates to a process for the rapid cooling of a continuous casting bar, rod or slab bar, resting on a track and sprayed with water. According to this application, this process is characterized in that said bar is moved by a to-and-fro movement during the entire cooling time, the travel of this movement being greater in the direction of extraction than in the opposite direction.

U.S. Pat. No. 6,309,482 relates to the in-line combination of a reversing mill (Steckel mill) and of the coil furnaces thereof with an accelerated cooling machine controlled immediately downstream therefrom and the associated process for sequentially rolling steel reversibly to obtain an overall reduction of at least around 3:1.

U.S. Pat. No. 9,643,224 relates to a device for cooling rolled products, preferably for cooling during cold rolling, comprising a nozzle for the application of a cooling agent on the rolled products, a cooling chamber in fluidic communication with the nozzle and extending substantially parallel with the plane of travel of the strip being provided for the application of the cooling agent on the rolled products.

Patent EP2979769 relates to a method and an installation for manufacturing a steel rolling ingot whereby a high-quality steel having less quality variation can be provided. It also relates to a process for manufacturing a steel sheet, comprising a step of hot rolling, a step of shape correction and a step of accelerated cooling in that order.

SUMMARY

The problem addressed by the present invention is that of enhancing the productivity of reversing mills without degrading the metallurgical quality of the products obtained, or by enhancing the metallurgical quality and/or the productivity of the other fabrication steps. There is in particular a demand in the automotive industry for methods having a high productivity to provide superior-quality 6xxx alloy sheets, particularly in terms of mechanical strength, formability and assemblability, and surface appearance after painting.

Subject Matter of the Invention

The invention firstly relates to a hot reversing mill comprising two work rolls, a top work roll (21) and a bottom work roll (22), and at least one cooling system intended to cool a blank (11), said blank (11) moving on reels (23) and passing through the hot reversing mill between the two work rolls (21) and (22), said cooling system consisting of two cooling devices: a top cooling device of the blank (11) and a bottom cooling device of the blank (11) characterized in that:

the top cooling device comprises at least one bar (30) of nozzles (35) disposed substantially parallel with the axis of the top work roll (21), the nozzles (35) spraying with jets of cooling fluid (36) the top face of the blank (11), The bottom cooling device comprises at least one bar (40) of nozzles (45) disposed between the reels (23) or between the bottom work roll (22) and the nearest reel (23), substantially parallel with the axis of the bottom work roll (22), the nozzles (45) spraying with jets of cooling fluid (46) the bottom face of the blank (11), the axis of the jets of cooling fluid (46) being oriented substantially perpendicularly to the bottom surface of the blank (11).

The invention further relates to a process for hot rolling aluminum alloys comprising the successive steps of a. providing a rolling ingot made of aluminum alloy with one or more aluminum alloys at a hot rolling input temperature,
b. carrying out a plurality of hot rolling and/or cooling passes with the hot mill according to the invention, the cooling system serving at least once,
c. transferring the blank (11) or the finished product in sheet or strip form at a hot rolling output temperature for the remainder of the fabrication process.

The invention further relates to a process for hot rolling an AA6xxx series aluminum alloy comprising the successive steps of:

a. casting a rolling ingot made of AA6xxx series alloy,
b. homogenizing the rolling ingot, optionally followed by a reheating,
c. first hot rolling to convert the rolling ingot into a blank having a first output thickness from a first hot rolling starting temperature,
d. cooling the blank obtained with a typical mean cooling rate of the mean temperature of the blank of the order of V=C/e up to a second starting temperature of second hot rolling, where V is in ° C./s, e is the thickness of the blank in mm, and C is a constant which equals between 400 and 1000° C./s*mm, preferentially between 600 and 900° C./s*mm, more preferentially between 700 and 800° C./s*mm,
e. second hot rolling to convert the blank obtained into a strip at the final hot rolling thickness under deformation and temperature conditions such that the strip is recrystallized to at least 50%,
f. cold rolling the strip into a sheet.

The invention further relates to a sheet obtained according to the process according to the invention, such that after solution heat treatment in a continuous heat treat furnace operating such that the equivalent hold time at 560° C., $$t_{eq}^{560°},$$

is less than 20 s, the equivalent hold time being calculated using the equation $$t_{eq}^{560°} = \int_{time\ in\ furnace} \exp\left[-\frac{Q}{R}\cdot\left(\frac{1}{T^{\circ}C\cdot(t)+273} - \frac{1}{560+273}\right)\right]\cdot dt$$

Q being an activation energy of 200 KJ/mol and R=8.314 J/mol/K, it attains a tensile strength of at least 90% and preferably at least 95% of the maximum tensile strength obtained after solution heat treatment with an equivalent hold time at 560° C., $$t_{eq}^{560°},$$

of 98 s.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF A PREFERRED EMBODIMENT

Figure 1:
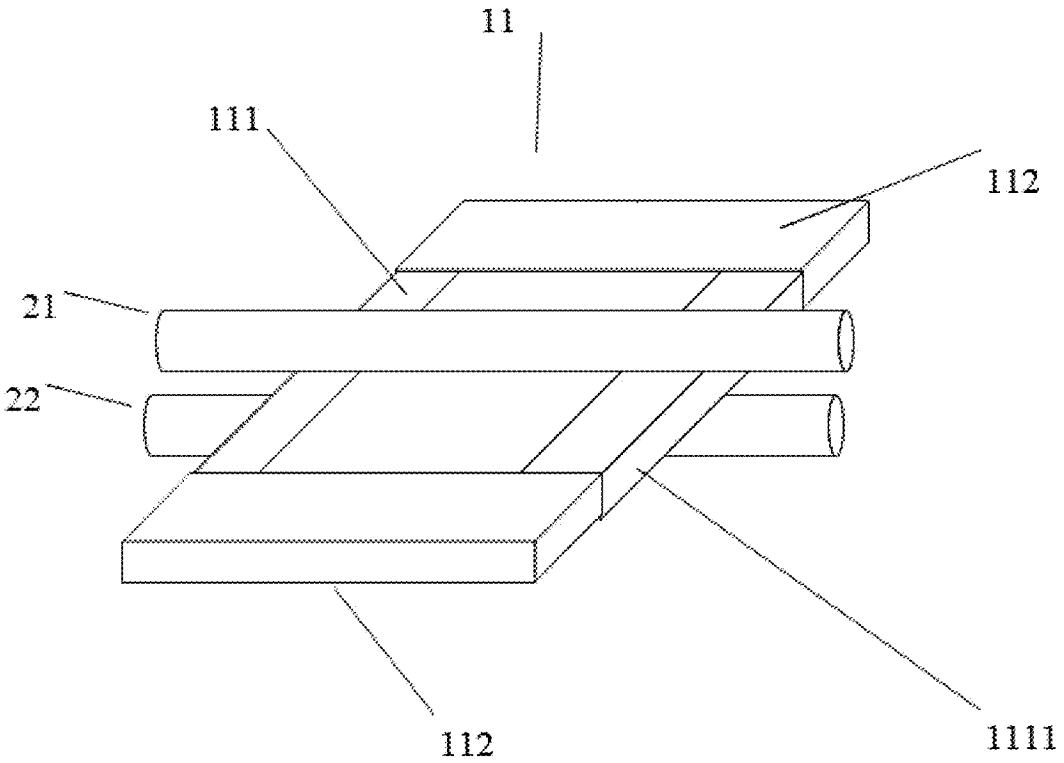
FIG. 1: perspective diagram of a blank passing through a mill, the cooling system not being represented.

All the aluminum alloys in question hereinafter are described, unless specified otherwise, according to the rules and descriptions defined by the "Aluminum Association" in the "Registration Record Series" published regularly thereby.

The tempers in question are described as per the European standard EN-515.

The tensile static mechanical characteristics are determined by means of a tensile test as per the standard NF EN ISO 6892-1.

Unless specified otherwise, the definitions of the standard EN 12258 apply.

Blank denotes herein an intermediate aluminum alloy product obtained by rolling a rolling ingot such as an ingot or a foundry slab, optionally scalped, optionally clad with one or more aluminum alloys, intended for manufacturing a finished product in the form of strip sheets or foils made of aluminum alloy, optionally clad with one or more aluminum alloys. A blank is therefore a rolled product, the thickness whereof is intermediate between the rolling ingot and the finished product.

Unless specified otherwise, the term "mill" refers herein to a "reversing mill".

Unlike the prior art wherein either the productivity of reversing mills is increased by increasing the capacity of the mill in terms of rolling load and/or torque, or the productivity of the prior or subsequent steps are enhanced, the present inventors succeeded in enhancing the productivity of the reversing mills without using these solutions.

The present inventors particularly observed that given the hardness thereof, most aluminum alloys tend to overheat excessively at each stepover. It is then necessary to slow the mill by performing less substantial stepovers for example or by leaving a waiting time between each rolling pass.

According to the invention, it was observed that cooling the blank during the hot rolling step makes it possible to enhance the productivity of a hot mill or create more economical novel manufacturing processes by removing production steps, while retaining an identical or enhanced metallurgical quality of the products. Thus, cooling the blank during rolling on reversing mills can also surprisingly make it possible to give the finished rolled product additional physical properties, such as mechanical properties, surface condition or corrosion resistance.

The hot reversing mill according to the invention comprises two work rolls, a top work roll (21) and a bottom work roll (22), and at least one cooling system intended to cool a blank (11), said blank (11) moving on reels (23) and passing through the hot reversing mill between the two work rolls (21) and (22), said cooling system consisting of two cooling devices: a top cooling device of the blank (11) and a bottom cooling device of the blank (11). The numerous other parts and systems of the hot mill well-known to those skilled in the art, for example, non-restrictively, back up rolls, motors, columns, spindles, are not represented in the figures.

The top cooling device comprises at least one bar (30) of nozzles (35) disposed substantially parallel with the axis of the top work roll (21), the nozzles (35) spraying with jets of cooling fluid (36) the top face of the blank (11). The bottom cooling device comprises at least one bar (40) of nozzles (45) disposed between the reels (23) or between the bottom work roll (22) and the nearest reel (23), substantially parallel with the axis of the bottom work roll (22), the nozzles (45) spraying with jets of cooling fluid (46) the bottom face of the blank (11), the axis of the jets of cooling fluid (46) being oriented substantially perpendicularly to the bottom surface of the blank (11).

FIG. 1 shows a blank (11) passing through a hot reversing mill (the cooling system is not represented in this figure). FIG. 1 shows the edges (111), the edges (1111) and the ends (112). The blank (11) is represented in a simplified manner as a parallelepiped while the reality is more complex.

The ends (112) correspond to the part of the blank (11) which is engaged first or which is disengaged last from the roll bite of the rolls (21) and (22). The ends (112) are represented in FIG. 1 in a simplified manner as a parallelepiped. Those skilled in the art know the ends (112) well as they should be removed to ensure the manufacture and the quality of the end product. The ends (112) are generally deformed by bending and by opening into two under the effect of the hot rolling, this phenomenon is called "crocodiling" by those skilled in the art. The ends (112) also correspond to the zones of the blank where the rolling is not homogeneous lengthwise. The ends (112) can also contain zones corresponding to the transient states of start or end of casting during which the ingot was manufactured. The length of the ends (112) is dependent on the alloys, the rolling and casting conditions, and the final applications.

This removal of the ends (112) can take place both on shears set up on the hot table and later in the manufacturing process according to the specific constraints of the end product and the manufacturing process thereof. The length of the ends (112) can typically take maximum values of 100 mm, 200 mm, 300 mm, 400 mm, 500 mm or 600 mm. The edges (1111) are the faces connecting the top face of the blank (11) in contact with the top roll (21) and the bottom face of the blank (11) in contact with the bottom roll (22) without being part of the ends (112). The edges (111) are the part of the blank (11) in the vicinity of the edges (1111) excluding the ends (112). The edges (111) are well-known to those skilled in the art as they must be removed to ensure the manufacture and the quality of the finished product. In the industrial reality, the edges (111) and the edges (1111) have a much more complex shape than that represented schematically by FIG. 1 as cracks and pinch marks, well-known to those skilled in the art, frequently appear therein. These deformations must be removed. The edges (111) are not rolled homogeneously widthwise given the proximity of the edges (1111) and they must be removed in order to ensure the properties of the end product. This removal of the edges (111) can take place both at the end of hot rolling and later in the manufacturing process according to the specific constraints of the end product and the manufacturing process thereof. The width of the edges (111) can typically take maximum values of 25 mm, 50 mm, 50 mm, 75 mm, 100 mm, 125 mm, 150 mm, 175 mm, 200 mm or 250 mm.

Figure 2:
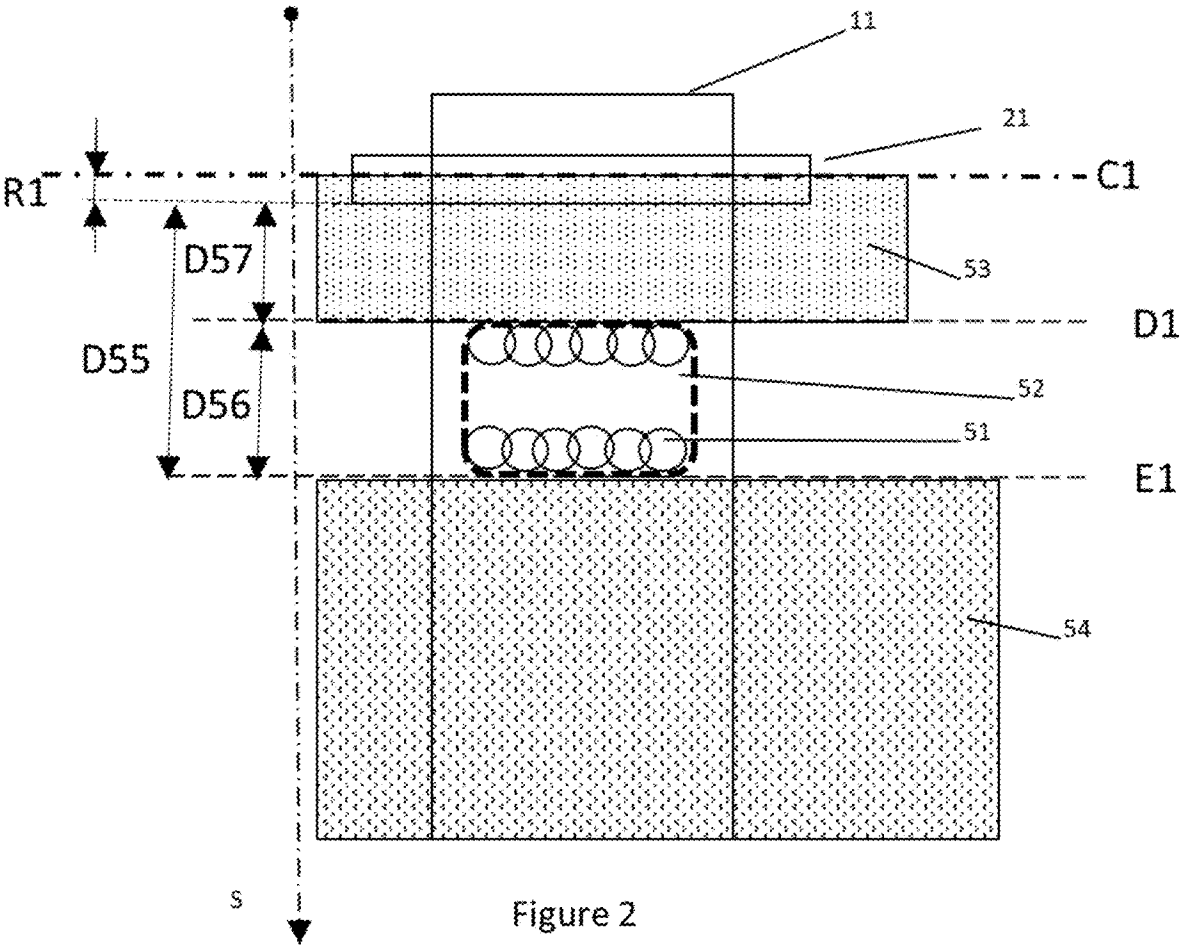
FIG. 2: top view of a blank passing through a mill according to the invention, the convex envelope of the surfaces sprayed directly by the jets of cooling fluid upon the first impact thereof on the blank being represented.
Figure 3:
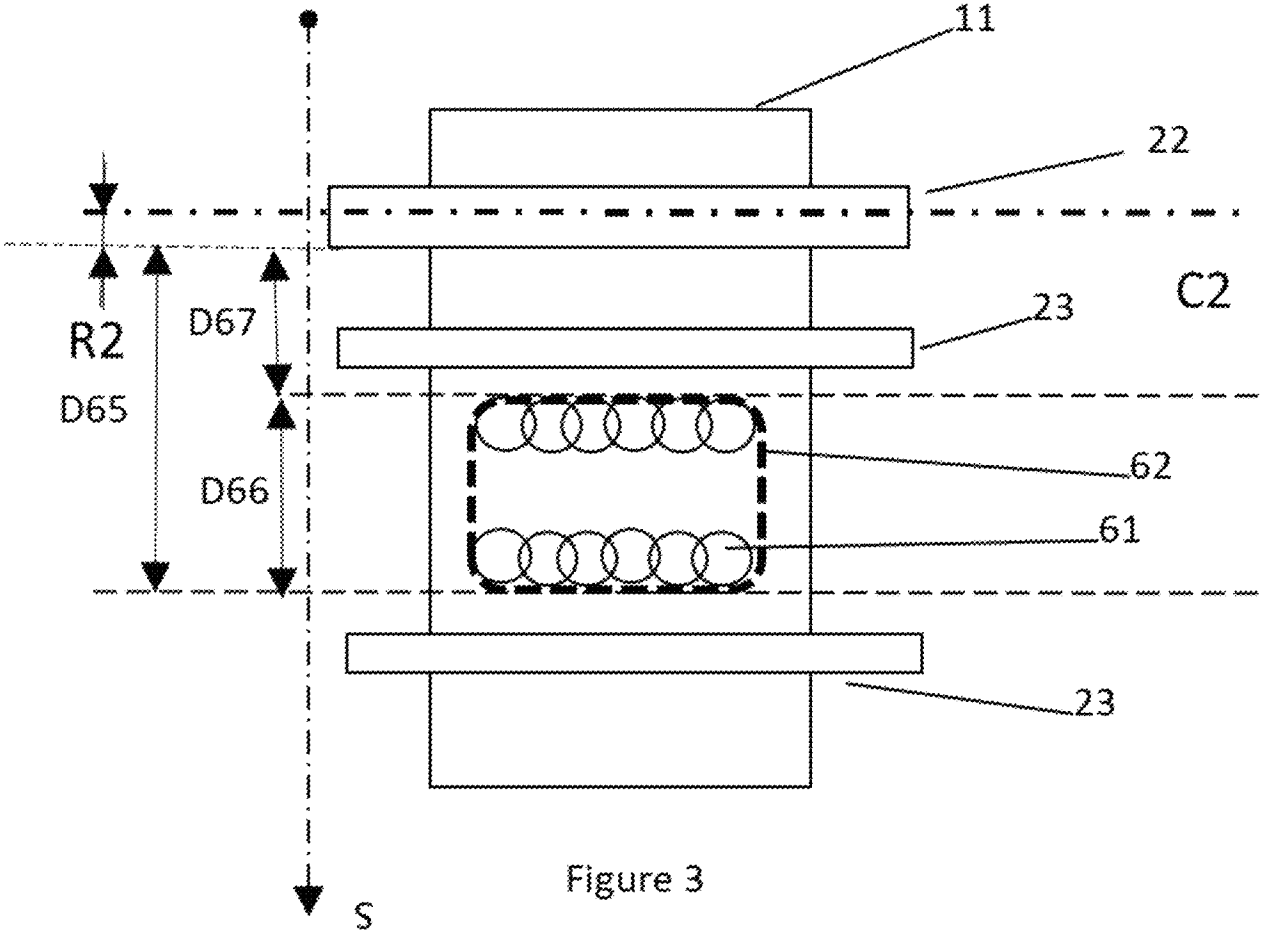
FIG. 3: bottom view of a blank passing through a mill according to the invention, the convex envelope of the surfaces sprayed directly by the jets of cooling fluid upon the first impact thereof on the blank being represented.
Figure 7:
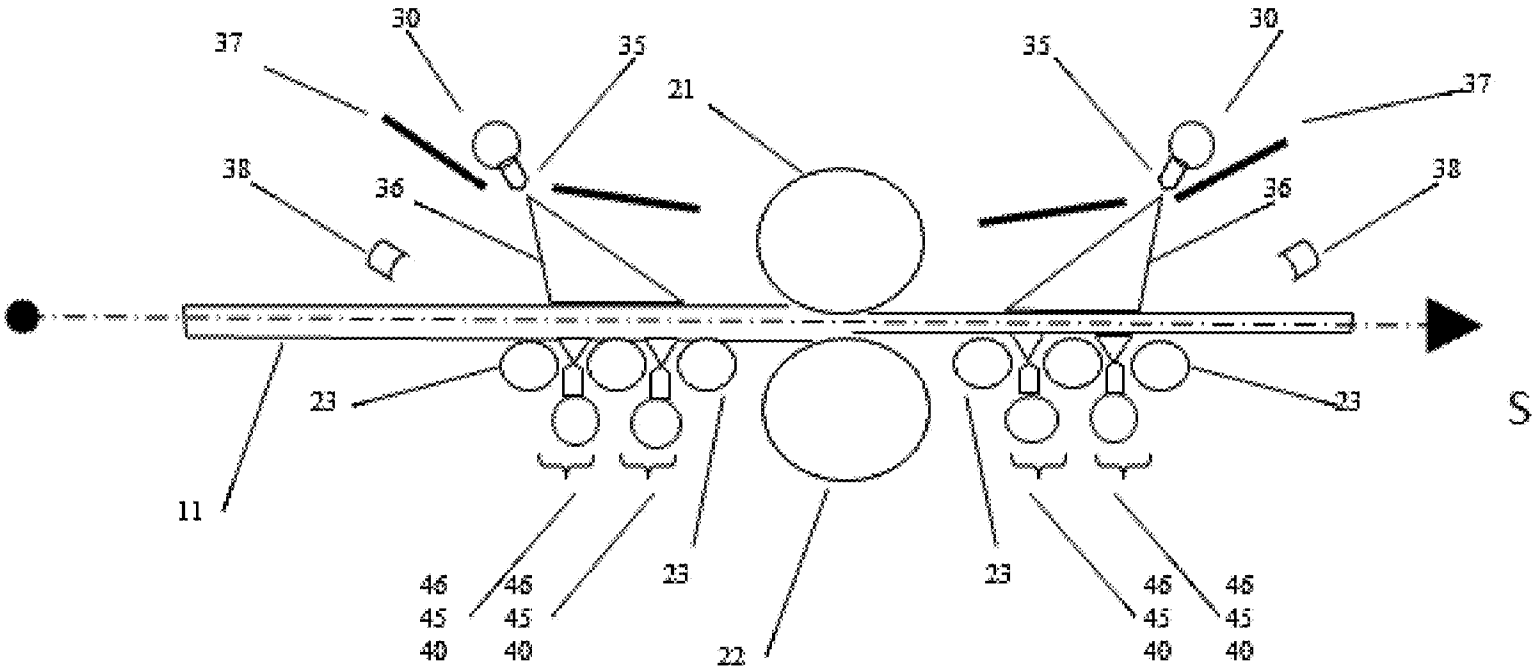
FIG. 7: longitudinal sectional diagram of a further embodiment of a mill according to the invention.
Figure 15:
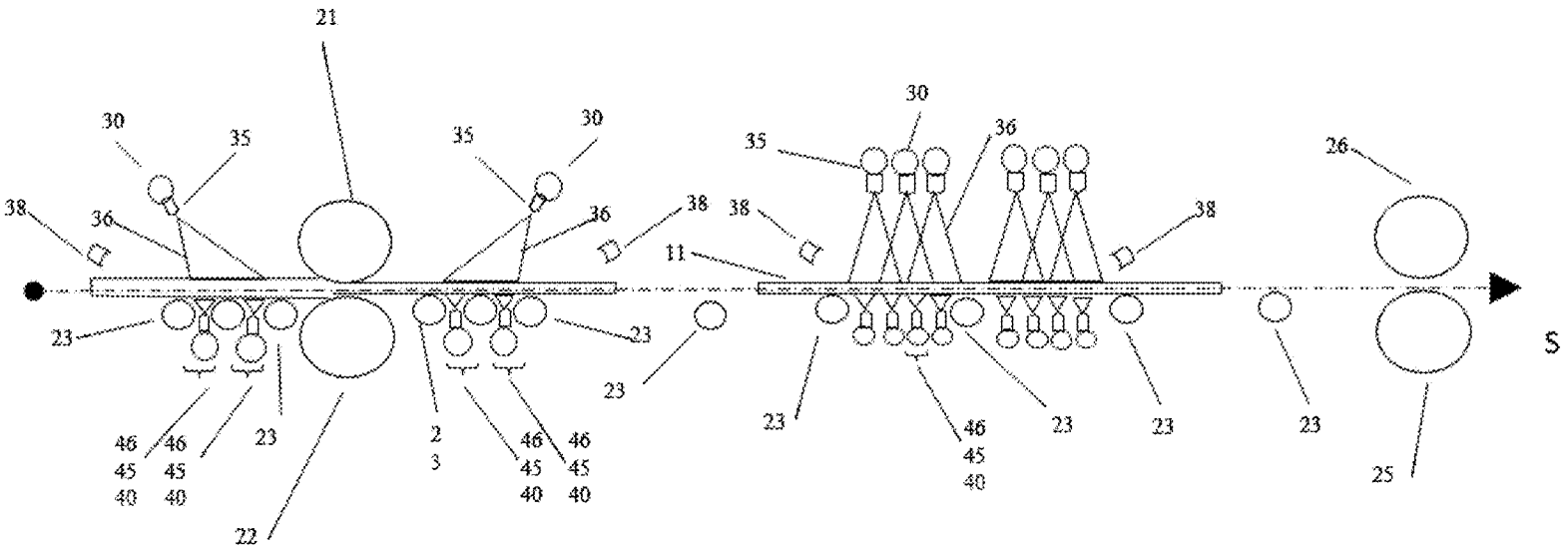
FIG. 15: a longitudinal sectional diagram of a further embodiment of a mill according to the invention.

For each cooling system, a top (52) respectively bottom (62) convex envelope is defined as the convex envelope of the surfaces (51) respectively (61) sprayed directly by the jets of cooling fluid (36) respectively (46) upon the first impact thereof on the blank (11). An example of convex envelope (52, 62) of the sprayed surfaces (51, 61) is illustrated by FIGS. 2 and 3 where the cooling system is not represented. Spatter and runoff are not taken into account in the convex envelope. An assembly is convex if for any segment, the ends whereof are in this assembly, each point of the segment is entirely included in this assembly. The convex envelope of an assembly is the smallest convex assembly containing same. The determination of the convex envelopes is conducted by separating the different cooling systems according to the function thereof. Two cooling systems are separated if the rolls (21) and (22) are between them. FIG. 7 illustrates a non-limiting example comprising a second cooling system. In this example, the convex envelopes of each system are analyzed separately as one system cools the blank (11) before the passage between the rolls (21) and (22) and the other after the passage between the rolls (21) and (22). Two cooling systems are separated when there are at least two, or at least three, or at least four, or at least five rollers (23), between which there is no cooling nozzle (45) of the bottom face of the blank. FIG. 15 shows an example with 3 cooling systems, two on either side of the hot reversing mill and a third which is farther away and which serves, in the case of this non-limiting example, for a rapid cooling before transferring the blank (11) to a second hot mill with the rolls (25) and (26) thereof. It is noted that in FIG. 15 two blanks are represented at two positions although it is possible that these blanks might not be simultaneously present.

As illustrated by FIG. 2, for each cooling system, the maximum distance D55 to the roll (21) from the convex envelope (52) is the maximum of the distance from any point of the convex envelope (52) with the line C1 which is the projection of the axis of rotation of the roll (21) on the top surface, of the blank (11), less the radius R1 of the roll (21).

As illustrated by FIG. 2, for each cooling system, the minimum distance D57 from the convex envelope (52) to the roll (21) is the minimum of the distance from any point of the convex envelope (52) with the line C1 which is the projection of the axis of rotation of the roll (21) on the top surface, of the blank (11), less the radius R1 of the roll (21).

As illustrated by FIG. 3, for each cooling system, the maximum distance D65 to the roll (22) from the convex envelope (62) is the maximum of the distance from any point of the convex envelope (62) with the line C2 which is the projection of the axis of the roll (22) on the bottom surface, of the blank (11), less the radius R2 of the roll (22).

As illustrated by FIG. 3, for each cooling system, the minimum distance D67 from the convex envelope (62) to the roll (22) is the minimum of the distance from any point of the convex envelope (62) with the line C2 which is the projection of the axis of the roll (22) on the bottom surface, of the blank (11), less the radius R2 of the roll (22).

For each cooling system, the zone opposite the mill (54) and the zone next to the mill (53) are surfaces which are part of a half-plane which contains the top convex envelope (52) of the blank (11) considered as the simplified parallelepiped in FIG. 1 and which is delimited by the line C1.

For each cooling system, as illustrated in FIG. 2, the zone opposite the mill (54) is a half-plane which does not contain the convex envelope (52) and which is delimited by a line E1 which is parallel with the line C1 and at the maximum distance D55 plus the radius R1 of roll (21) of the line C1.

For each cooling system, the zone next to the mill (53) is delimited by the line C1 and by the line D1 which is parallel with the line C1 and at the minimum distance D57 plus the radius R1 of roll (21) of the line C1.

The direction S is that of the movement of the blank (11).

According to FIG. 2, for each cooling system, the distance D56 according to the direction S from the convex envelope (52) is the subtraction of the length D57 from the length D55.

According to FIG. 3, for each cooling system, the distance D66 according to the direction S from the convex envelope (62) is the subtraction of the length D67 from the length D65.

Figure 6:
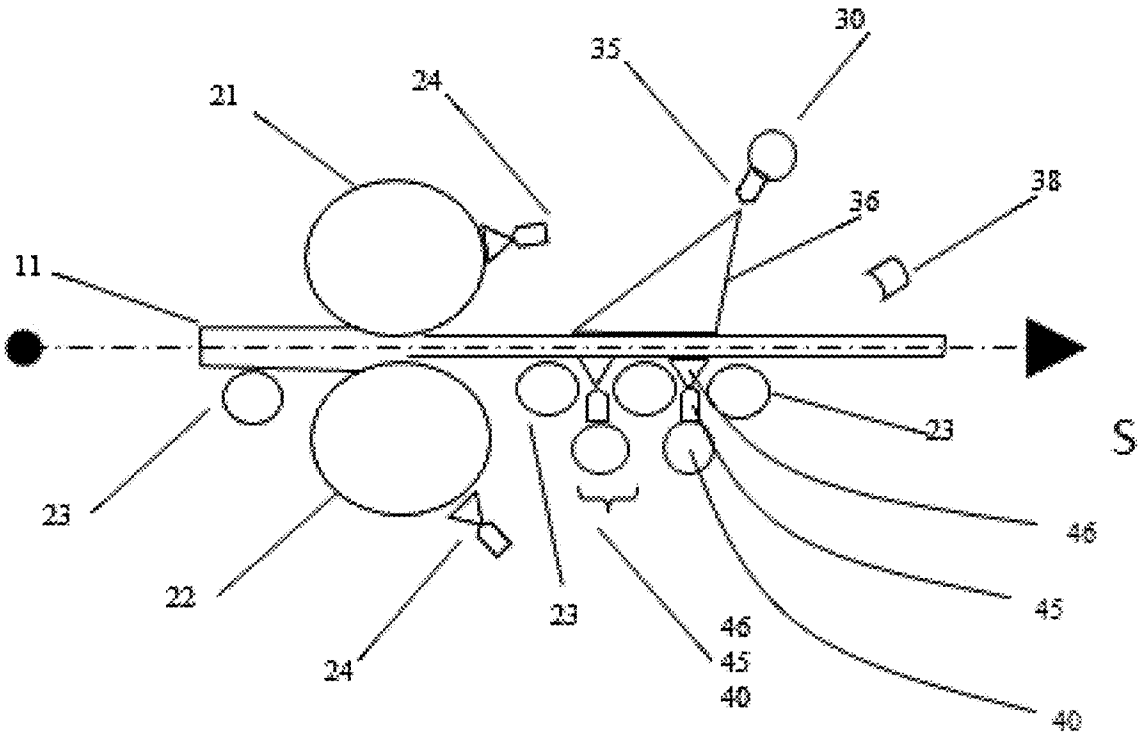
FIG. 6: longitudinal sectional diagram of an embodiment of a mill according to the invention.

In the embodiment illustrated in a non-limiting manner by FIG. 6, the top cooling device consists of a bar (30) of nozzles (35) disposed substantially parallel with the axis of the top work roll (21), the nozzles (35) spraying with jets of cooling fluid (36) the top face of the blank (11). The bottom cooling device illustrated by FIG. 6 consists of two bars (6) of nozzles (45) disposed between the reels (23), substantially parallel with the axis of the bottom work roll (22), the nozzles (45) spraying with jets of cooling fluid (46) the bottom face of the blank (11), the axis of the jets of cooling fluid (46) being oriented substantially perpendicularly to the bottom surface of the blank (11). In an embodiment illustrated by FIG. 10, the bottom cooling device consists of a bar of nozzles (45) located between the bottom work roll (22) and the nearest reel (23).

Figure 8:
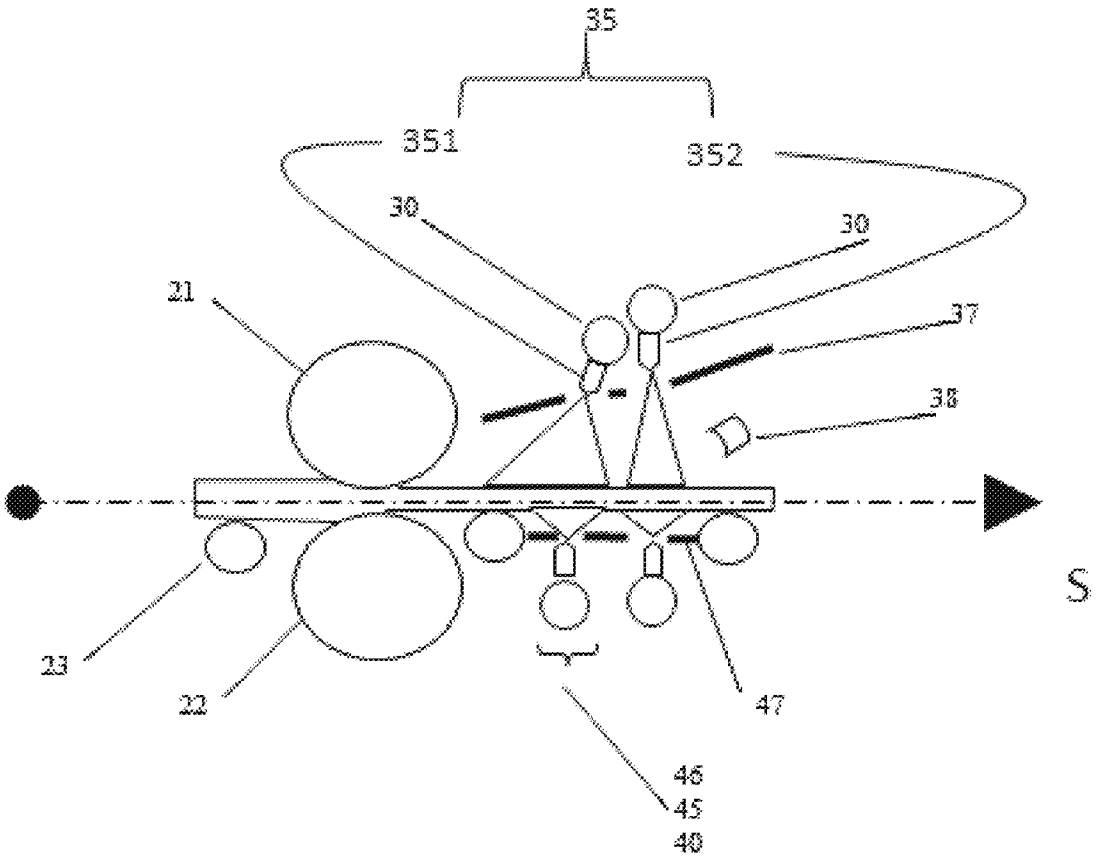
FIG. 8: longitudinal sectional diagram of a further embodiment of a mill according to the invention.
Figure 12:
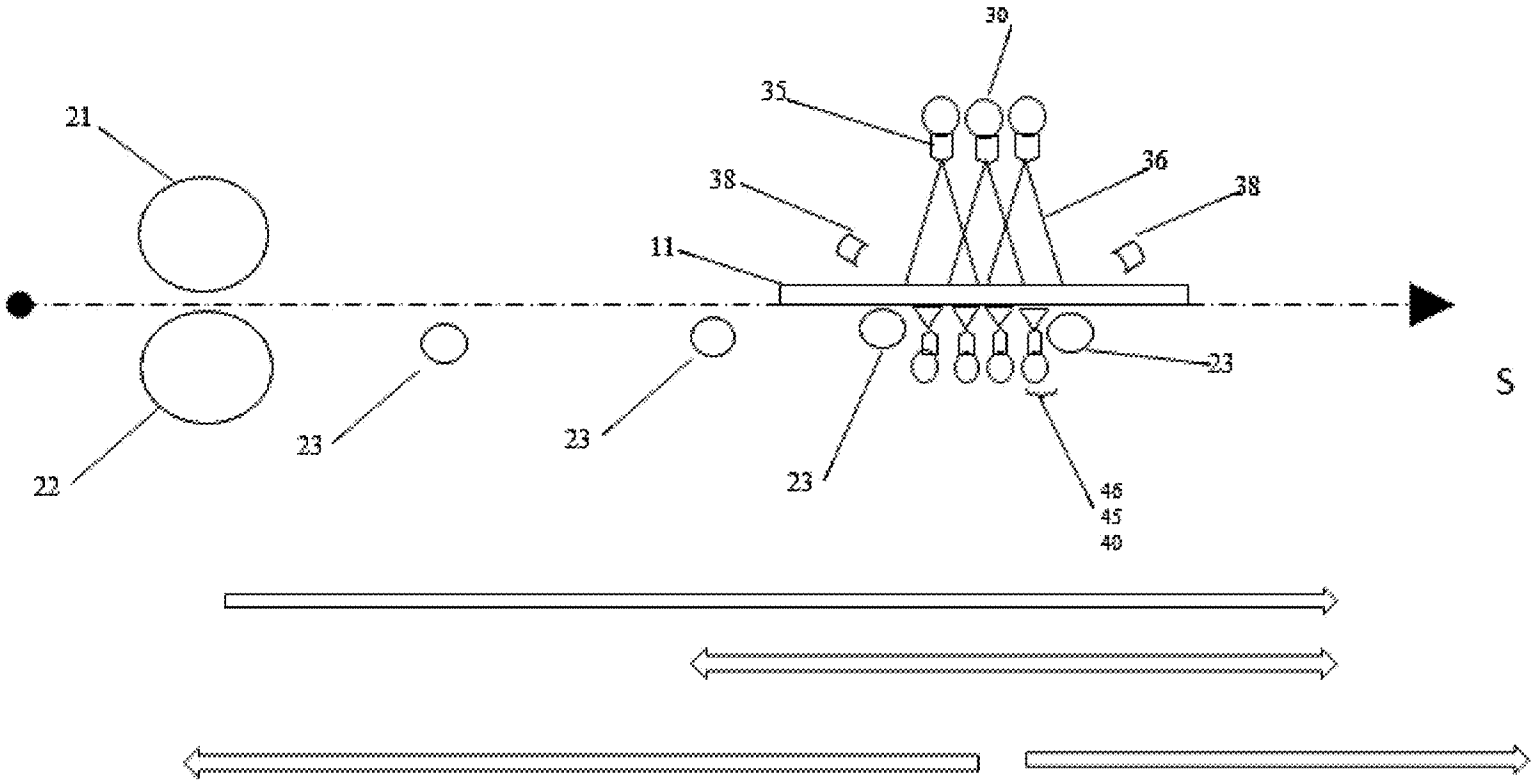
FIG. 12: longitudinal sectional diagram of a further embodiment of a mill according to the invention.

The embodiments illustrated in a non-limiting manner for example by FIG. 8 and FIG. 12 show top cooling devices consisting respectively of two and three bars (30) of nozzles (35).

Figure 5A:
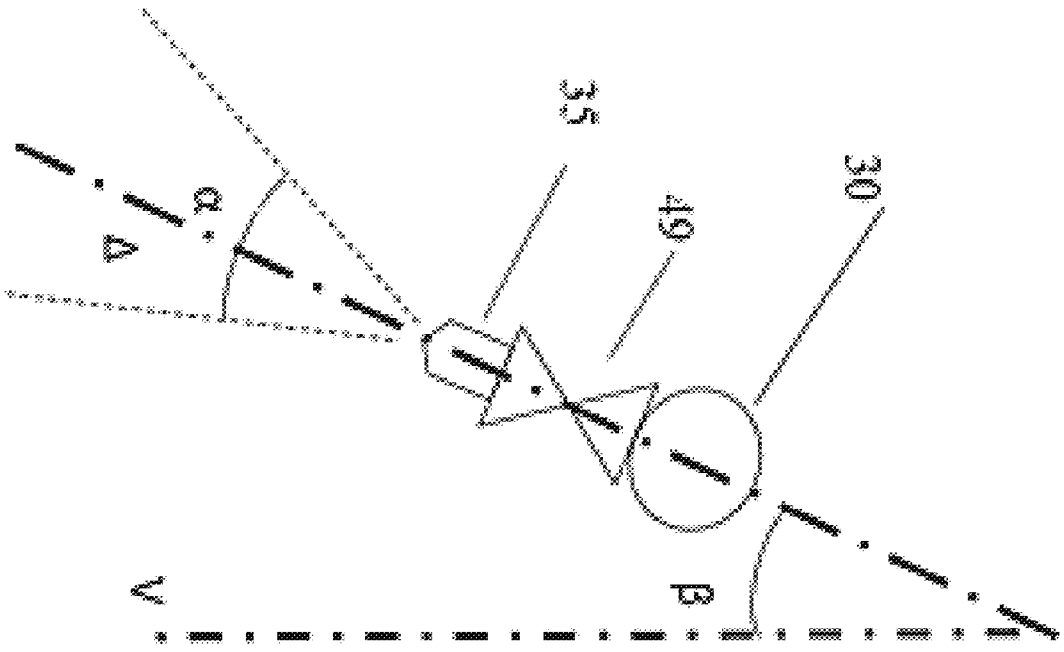
FIG. 5*a*: diagram of nozzles with rapid response valves.
Figure 5B:
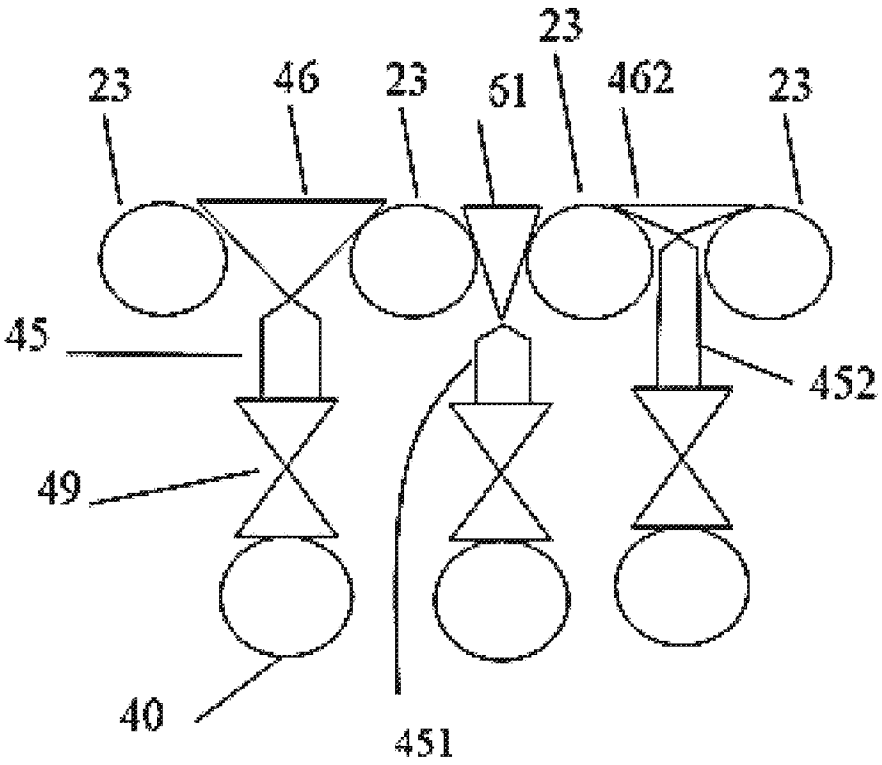
FIG. 5*b*: diagram of nozzles with rapid response valves.

Preferentially, the bottom nozzles (45) produce jets of cooling fluid (46) which do not reach either the reels (23) or the roll (22) directly in the presence of the blank (11) and which are preferentially almost tangent to the reels (23) and the distance D67 whereof is preferentially greater than a radius of the bottom roll (22), more preferentially than the diameter of the bottom roll (22) and/or the top nozzles (35)

produce jets of cooling fluid (36) which do not reach the top work roll (21) directly, preferentially the distance D57 is greater than the radius of the top roll (21), more preferentially the distance D57 is greater than the diameter of the top roll (21). In an embodiment illustrated by FIG. 5*b*, the jets of cooling fluid (46) do not reach the reels (23) directly so that these jets only influence the temperature of the blank (11). In an embodiment illustrated by FIG. 10, wherein the bar (40) is disposed between the roll (22) and a reel (23), the jets of cooling fluid (46) do not reach the roll (22) directly so that these jets only influence the temperature of the blank and do not disrupt the temperature field of the roll (22) which is an important factor for hot rolling quality. It is advantageous that the distance D67 be greater than the radius R1 of the bottom roll (22), preferentially than the diameter of the bottom roll (22) to prevent spatter from the jet of fluids (46) being able to reach the roll (22) and disrupt the temperature field of the roll (22). It is also advantageous that the zone of the bottom surface of the blank (11) sprayed by the bottom jets of cooling fluid (46) be maximized to enhance heat exchange. To maximize the surface area sprayed by the jets (46) without touching the reels (23), it is advantageous that the jets (46) pass flush with said reels (23) without touching them as illustrated by FIG. 5*b*. These bottom jets (46) are therefore preferably almost tangent to the reels (23). The invention thus makes it possible to maximize the sprayed surface area to increase the useful surface area for heat exchange. The jets (36) advantageously do not touch the rolls (22) so as not to disrupt the temperature field of the roll (21) which is an important factor for hot rolling quality. It is advantageous that the distance D57 be greater than the radius R1 of the top roll (21), preferentially that the distance D57 be greater than the diameter of the top roll (21) to prevent spatter from the jet of fluids (36) being able to reach the roll (21) and disrupt the temperature field thereof.

Nozzles (24) illustrated in FIG. 6 and dedicated to the rolls (21) and (22) can be installed in order to cool or lubricate these devices according to the specific needs thereof independently of the blank (11). In an embodiment not illustrated, specific nozzles can be installed to cool the reels (23). The position of the nozzles (24) in FIG. 6 is merely by way of principle and is not limiting.

Figure 9:
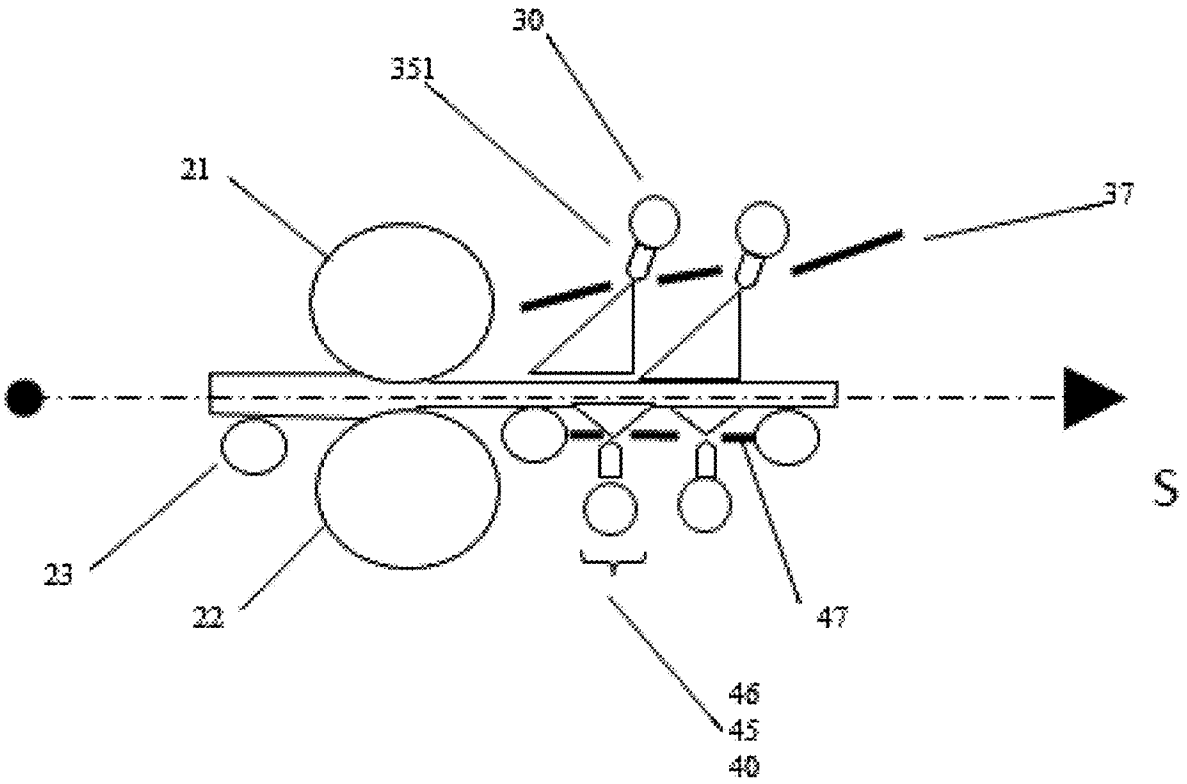
FIG. 9: longitudinal sectional diagram of a further embodiment of a mill according to the invention.
Figure 13:
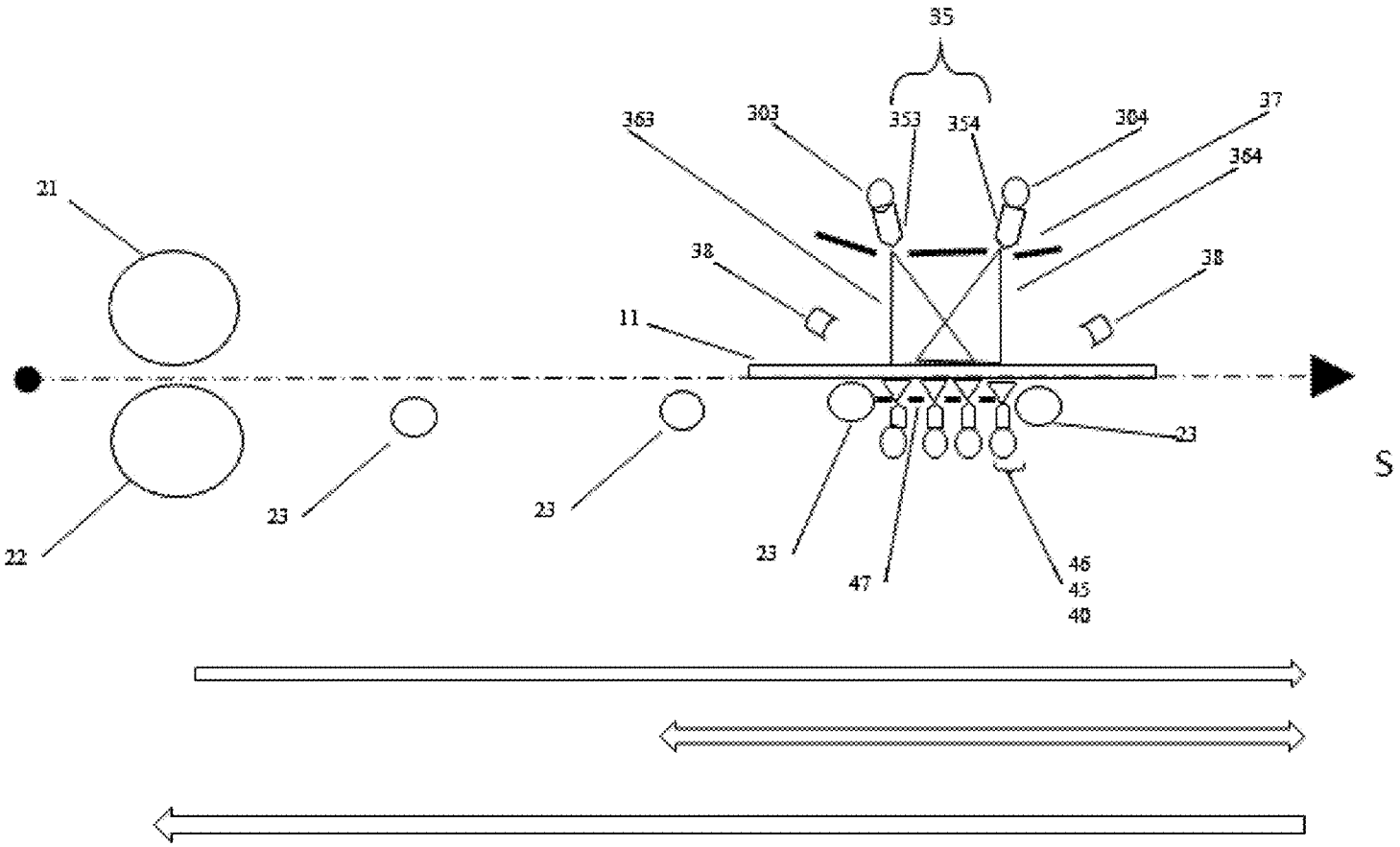
FIG. 13: longitudinal sectional diagram of a further embodiment of a mill according to the invention.

Preferably, the bottom nozzles (45) are below the plane passing through the axes of rotation of the reels (23) located in the vicinity of said nozzles (45) and/or the bottom nozzles (45) are protected by a component (47) having openings to allow the jets of cooling fluid (46) to pass and/or the top nozzles (35) are protected by a component (37) having openings to allow the jets of cooling fluid (36) to pass. Protecting the nozzles (35) and (45) is advantageous as hot rolling can cause an opening of the ends (112) of the blank (11) called "crocodiling" by those skilled in the art and which strikes the nozzles. The blanks (11) can also during the hot rolling form bridges or boats, i.e. the blank (11) instead of being substantially planar can curve in the longitudinal direction on coming out of the mill, the ends of the blank (11) pointing upward or downward. Protecting the nozzles (35) and (45) from the blanks (11) is therefore advantageous to prevent damage of said nozzles. A non-limiting example of the components (37) and (47) protecting the nozzles (35) and (45) is illustrated in FIG. 8, FIG. 9, and FIG. 13. FIG. 7 is a non-limiting example where only the nozzles (35) are protected by a protective component (47). When the reels (23) are very near one another, installing the nozzles (45) below the plane of the axes of the reels (23) makes it possible to protect them economically without installing protective components (47), as illustrated by FIGS. 6 and 7.

Preferentially, each nozzle (35) and (45) is supplied individually by a rapid response valve (49) the response time whereof is advantageously less than 1 s, preferentially less than 0.5 s, and more preferentially less than 0.2 s. FIGS. 5*a* and 5*b* show non-limiting examples of rapid response valves (49) mounted between a bar (30) respectively (40) and a nozzle (35) respectively (45). Supplying the nozzles individually with rapid valves is advantageous as this makes it possible to cool each point of the top surface and the bottom surface of the blank (11) specifically. These response times make it possible in particular to be able to spray sufficiently reliably the ends (112) of the blanks (11) to adjust the temperature thereof so as to facilitate the engagement thereof between the rolls (21) and (22). It is then possible to adapt the temperature at the ends (112) of the blank (11) to facilitate the engagement thereof in the hot reversing mill. It is also possible to adapt the temperature on the edges (111) to for example limit cracking phenomena which reduce the useful width of the blank or even which can induce the fracture thereof. It is therefore also possible to optimize the temperature of the other parts of the blank (11) according to the required properties on the finished product or according to the required properties for the subsequent steps of production. For example, this is advantageous for better controlling the properties of the end product such as for example the widthwise anisotropy for products made of AA3104 alloy or the uniformity of mechanical properties for products made of AA6xxx alloy. Finally, cooling each point of the blank (11) specifically also makes it possible to control the flatness of the blank (11) by controlling the effects of differential expansions.

In an embodiment, the nozzles (35) and (45) are suitable for producing jets of cooling fluid (36) and (46) in a flat and/or conical and/or cylindrical shape. If the shape of the jets is cylindrical, the cross-section of the roll is preferentially circular. In an embodiment, the nozzles (35) and (45) are suitable for producing jets of cooling fluid (36) and (46) by prilling, preferentially the nozzles (35) and (45) are suitable for producing jets of cooling fluid (36) and (46) by prilling, in a solid cone shape, referred to as conical jets. Conical jets (46) and (36) are a better configuration than flat or cylindrical jets. Indeed, conical jets enable a better distribution of the cooling fluid on the blank (11). This thus enables a more homogeneous heat exchange and it is thus possible to obtain a blank (11) with for example temperature heterogeneity of less than 20° C., preferentially of less than 10° C.

Preferentially, the conical jets of cooling fluid (46) have a cone angle of 90°. This angle can be limited, for example to 60°, by the presence of the reels (23) so as not to spray them in particular when the nozzles (45) are below the plane passing through the axes of rotation of the reels (23). If the reels (23) are very close, it can be preferable to place the nozzles (45) above the plane passing through the axes of the reels (23) to spray a larger surface area (61). In FIG. 5*b*, the nozzle (451) is placed below the plane of the axes of rotation of the reels 23 and produces a cooling jet (461). In FIG. 5*b*, the nozzle (452) is placed above the plane of the axes of the reels (23) and produces a cooling jet (462), the protective component (47) that should preferentially be installed in this situation, is not shown. The jet (462) therefore sprays a larger surface of the blank (11), not shown, than the jet (461).

Figure 10:
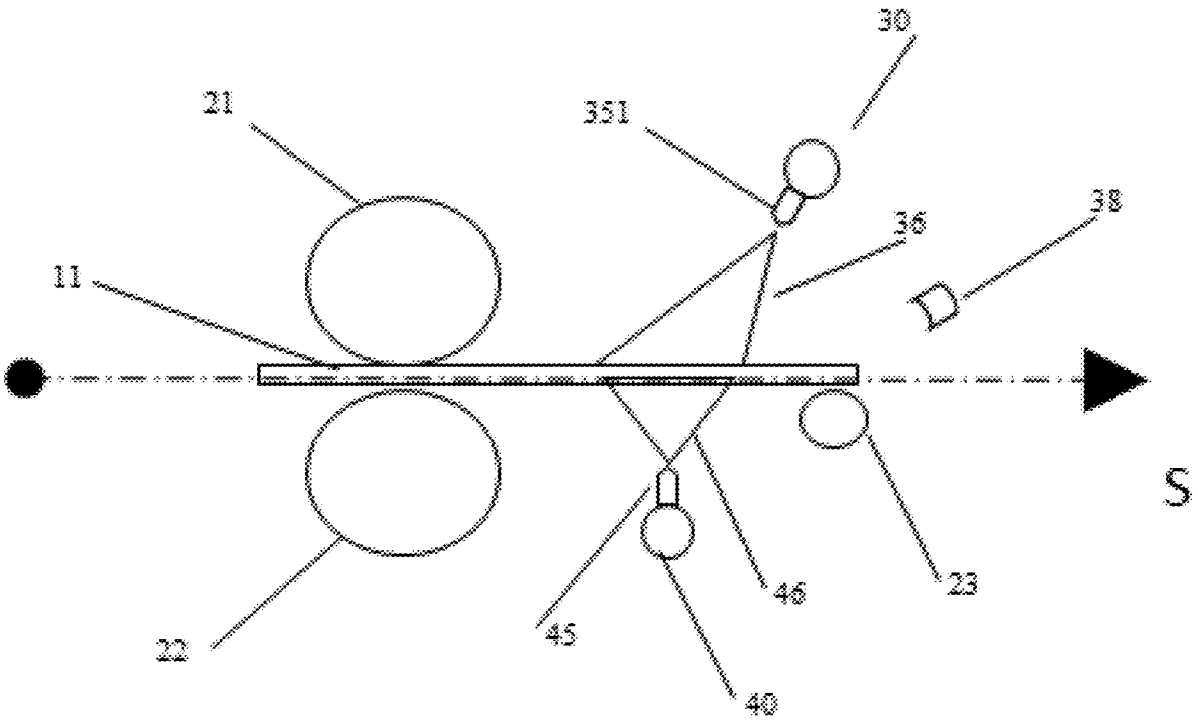
FIG. 10: longitudinal sectional diagram of a further embodiment of a mill according to the invention.

Preferentially, for each cooling system, at least one device (38) for discharging the cooling fluid from the top surface of the blank (11) is installed above the blank. Non-limiting examples of this device (38) are given with FIG. 8, FIG. 10 or FIG. 12. A device (38) can be installed above the zone opposite the mill (54) and/or above the zone next to the mill (53). Preferentially, said device (38) is an air blast which pushes the cooling fluid back toward one of the edges (111) of the blank (11) and preferentially gives the cooling fluid a sufficient speed so that it does not run onto the edges (1111). The device (38) makes it possible to prevent the runoff of the cooling fluid onto the entire top face of the blank (11). This helps ensure a controlled cooling to obtain a good repeatability and a good reproducibility of the heterogeneity of the temperature of the blank (11). Preventing the cooling fluid from running onto the edge (1111) contributes to the thermal control of the edges of the blank (11), and in particular makes it possible to prevent the edges from being overly cooled, which limits the appearance of cracks in the edges (111). When the top cooling device is in the vicinity of the roll (21), the device (38) for discharging the cooling fluid is advantageously supplemented or replaced by the roll (21) which acts as a dam blocking the runoff of the cooling fluid. This makes it possible in particular to reduce the energy consumption of the device (38). A non-limiting example of the configuration wherein the device (38) for discharging the cooling fluid in the vicinity of the roll (21) is replaced by the roll (21) is illustrated by FIG. 10.

In an embodiment, the conical jets of the top cooling device (36) have a cone angle $\alpha$ of at most 20°, preferentially substantially 15° or less and the cones of said conical jets have a substantially vertical axis. This configuration makes it possible to limit the runoff of the cooling fluid onto the blank (11). Preferentially, the cooling system having at least one such conical jet is framed by a device for discharging the cooling fluid (38) as illustrated in a non-limiting manner by FIG. 12. The cone angle $\alpha$ is illustrated by FIG. 5*a*, the cone angle $\alpha$ is the angle of the cone of the jet of cooling fluid produced by the nozzles.

In a further embodiment, the conical jets of the top cooling device (36) are inclined with respect to the vertical. The angle of inclination $\beta$ is illustrated by FIG. 5*a*, it consists of the angle formed by the axis of the nozzles with the line V perpendicular to the top face of the blank (11). Preferentially, the difference $\beta-\alpha/2$ is greater than −20°, preferentially greater substantially than −15°, more preferentially positive or zero. Preferentially, if the difference $\beta-\alpha/2$ is negative, a device for discharging the cooling fluid (38) is preferentially installed to prevent the runoff onto the surface of the blank (11). If the jets of cooling fluid of the top cooling device (36) are in the vicinity of the work roll (21), the axis of the cooling fluid (36) are advantageously oriented to approach the sprayed surfaces (51) of the work roll (21) to benefit from the dam effect of the roll (21). This configuration also makes it possible to increase the sprayed surfaces (51) to increase the cooling capacity of the cooling system. If the jets of cooling fluid are at a distance from the work roll, it is advantageous to group the bars of the top cooling device (30) pairwise and orient the axes of the jets of cooling fluid (36) so as to approach the respective sprayed surfaces (51) thereof. This configuration is advantageous as it results in the cooling fluid being concentrated in at least a part of the overlap zone of the jets (36) and thus discharging the cooling fluid on the edges with sufficient speed so as not to run onto the edges (1111) of the blank (11), which makes it possible not to overly cool the edges (111) of the blank (11).

FIG. 8 is a non-limiting example of the preceding embodiments. The nozzles in the vicinity of the work roll (351) have the axis thereof oriented toward the work roll (21) and the difference $\beta-\alpha/2$ is greater than −20°. The nozzle (352) is oriented vertically and the angle $\alpha$ of the conical jet (36) thereof is less than 20°.

FIG. 9 is a further non-limiting example of the preceding embodiments. The nozzles in the vicinity of the work roll (351) are all inclined to approach the sprayed surfaces (51) toward the work roll and the different $\beta-\alpha/2$ of the conical jets is positive or zero to prevent the runoff of the cooling fluid onto the blank (11).

FIG. 12 is a further non-limiting example of the preceding embodiments with conical vertical cooling jets (36), the cone angle $\alpha$ whereof is less than 20°.

FIG. 13 is a further non-limiting example of the preceding embodiments. The bars (303) and (304) are paired, the nozzles (353) and (354) are oriented so that the sprayed surfaces (513) and (514), illustrated by FIG. 4, move closer together. The differences $\beta-\alpha/2$ are positive or zero.

Preferentially, for each cooling system, the top sprayed convex envelope (52) is facing with a tolerance of twice preferentially once the dimension of the diameter of the top work roll (21) of the bottom sprayed convex envelope (62), preferentially said convex envelopes (52, 62) are substantially facing. The determination of the convex envelopes is conducted by separating the different cooling systems according to the invention. FIG. 7 illustrates a non-limiting example where there is a second cooling system. In this case, the convex envelopes of each system are analyzed separately as one system cools before the passage between the rolls (21) and (22) and the other after the passage between the rolls (21) and (22). FIG. 15 shows an example with 3 cooling systems, two on either end of the hot reversing mill and a 3rd which is farther away and which serves, in the case of this non-limiting example, for a rapid cooling before reaching a second hot mill with the rolls (25) and (26) thereof. This arrangement is advantageous as it contributes to the thermal homogeneity of the blank (11). Placing said top and bottom convex envelopes (52, 62) of each cooling system facing one another is particularly advantageous as it enables a homogeneous cooling in the thickness of the blank (11), which helps control the flatness of the blank (11), which is an important feature for blanks which are flat products.

Preferentially, all of the nozzles (35) and (46) are suitable for supplying a surface flow per face of the blank (11) of cooling fluid of 1500 l/min/m$^2$ maximum, preferentially of 600 to 1200 l/min/m$^2$. This fluid can be propelled by a propellant gas. The cooling fluid can be water, deionized water, an optionally liquefied gas, preferentially the emulsion of water, preferentially deionized, and oil and rolling additives, used for lubrication of the rolls (21) and (22) with the blank (11). Preferentially, the deionized water has a resistivity greater than 105 kΩcm.

Figure 11A:
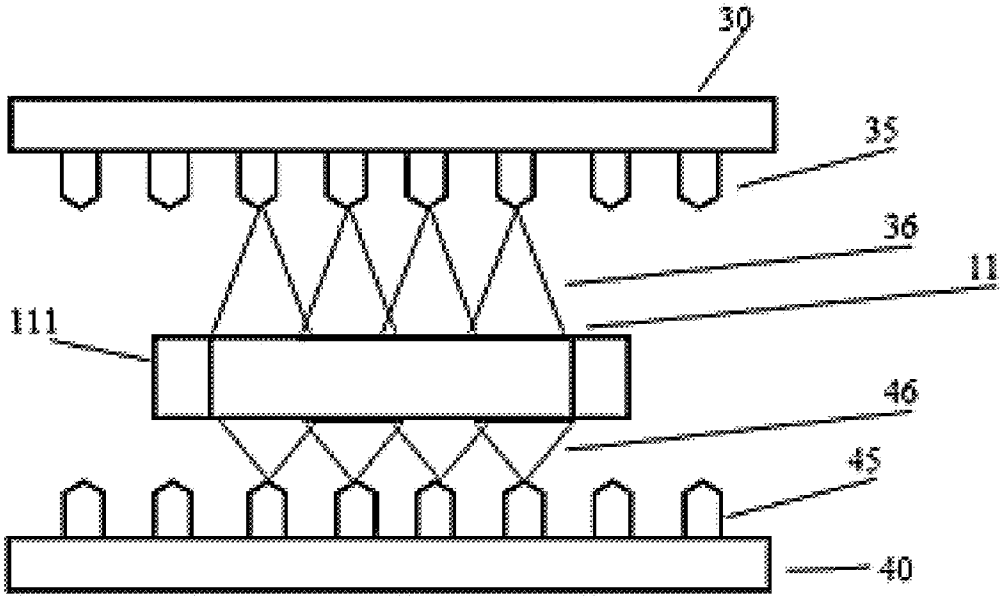
FIG. 11*a*: transversal sectional diagram of an embodiment of a mill according to the invention.
Figure 11B:
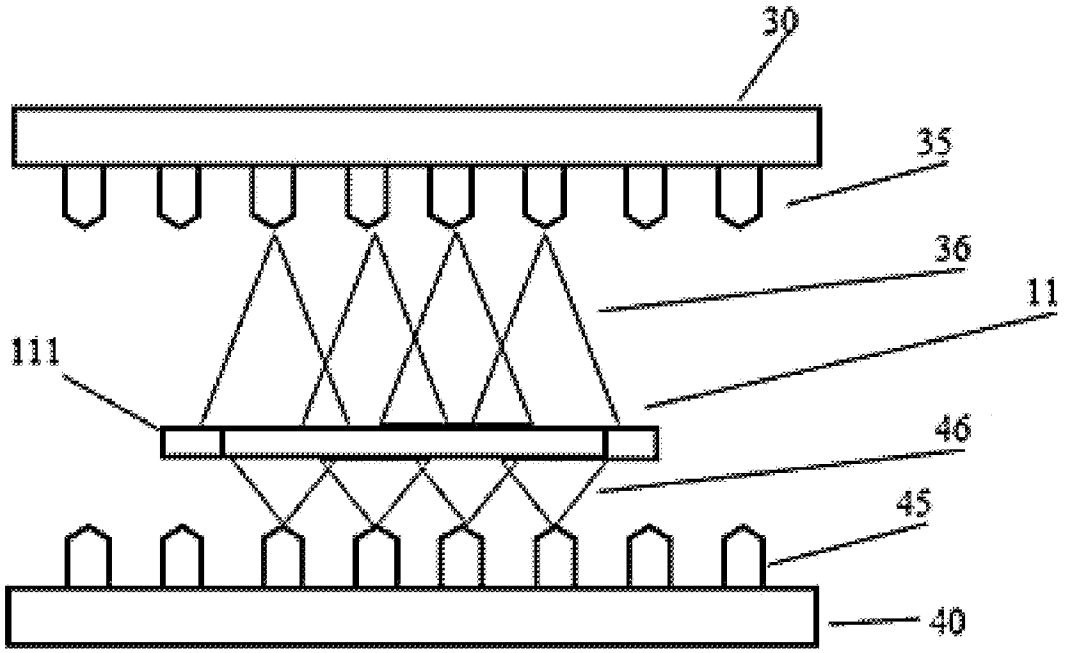
FIG. 11*b*: transversal sectional diagram of an embodiment of a mill according to the invention.

In an embodiment, the nozzles of the top cooling device (35) are movable and maintained at constant distance from the top surface of the blank (11), preferentially while being attached to the mechanism maintaining the roll (21). This makes it possible to ensure a better repeatability of the cooling of the blank (11). In a further embodiment, the nozzles (35) are not movable. In this less costly non-movable embodiment, it is necessary hence to pilot the nozzles (35) spraying the edges (111) or in the vicinity of the edges (111) for example in the case where the nozzles (35) produce conical jets (36). Indeed, in the case of the conical jets (36) sprayed by fixed nozzles (35), the distribution of cooling fluid onto the edges (111) widens as the thickness of the blank decreases during successive passes of the hot reversing rolling diagram. FIGS. 11*a* and 11*b* are non-limiting examples of this scenario. The blank (11) is shown at the start of hot rolling with FIG. 11*a* and at the end of hot rolling with FIG. 11*b* with each time the same number of top nozzles (35) producing jets of cooling fluid (36). Due to the conical shape of the jets (36) and the decrease in the thickness of the blank (11), the edges (111) are not sprayed at the start of rolling illustrated in 11*a* whereas they are partially sprayed at the end of rolling illustrated in 11*b*. Therefore, in an embodiment, the intersection between the top surfaces (51) sprayed directly with the jets of cooling fluid (36) with the top face of the edge (111) is empty at the start of hot rolling, preferentially for the entire duration of the hot rolling. Therefore, in an embodiment, the intersection between the bottom surfaces (61) sprayed directly by the jets of cooling fluids (46) with the bottom face of the edge (111) is empty at the start of hot rolling, preferentially for the entire duration of the hot rolling.

In a preferred embodiment, illustrated by way of non-limiting example in FIG. 10, the nozzles (351) in the vicinity of the top work roll (21) produce jets of cooling fluid (36) of which all the movement components, projected on the direction S of movement of the blank (11), are oriented toward the work rolls (21) and (22) of the mill. Preferentially, the jets of cooling fluids (36) of the top cooling device are conical and the difference $\beta-\alpha/2$ is positive or zero. In a more preferred embodiment as illustrated by FIG. 6, there is only one top bar (30) and two bottom bars (40).

In a preferred embodiment illustrated by the non-limiting example in FIG. 6, the top sprayed convex envelope (52) and the bottom sprayed convex envelope (62), not represented in FIG. 6, are in the vicinity of the rolls of the mill; preferentially the maximum distances D55 and D65 to the rolls (21) and (22) from the sprayed convex envelopes (52) and (62) are less than 3 times the largest of the diameters of the work rolls (21) and (22) and/or the lengths D56 and D66 of said convex envelopes (52, 62) are less than two diameters, preferentially one diameter of the largest of the work rolls (21) or (22). This embodiment is advantageous as it makes it possible to cool the blank (11) as soon as it comes out of the roll bite of the rolls (21) and (22) and prevent the blank from moving too far away from the rolls before going back in the other direction for the next hot rolling pass. This is particularly advantageous as this improves the productivity of the hot mill. Indeed, the speed of the hot reversing mills is frequently limited to prevent overheating which results in burns, cracks, crocodiling, or fractures of the blank (11).

In a preferred embodiment illustrated by a non-limiting example of FIG. 7, there is a second cooling system on the other side of said hot reversing mill, the second cooling system being preferentially symmetrical to the first with respect to a plane passing through the axes of the work rolls (21) and (22). This arrangement is advantageous as it makes it possible to cool the blank (11) until the entry thereof into the roll bite of the reversing mill and from the output thereof from the roll bite of the reversing mill at each rolling pass, identically.

Figure 4:
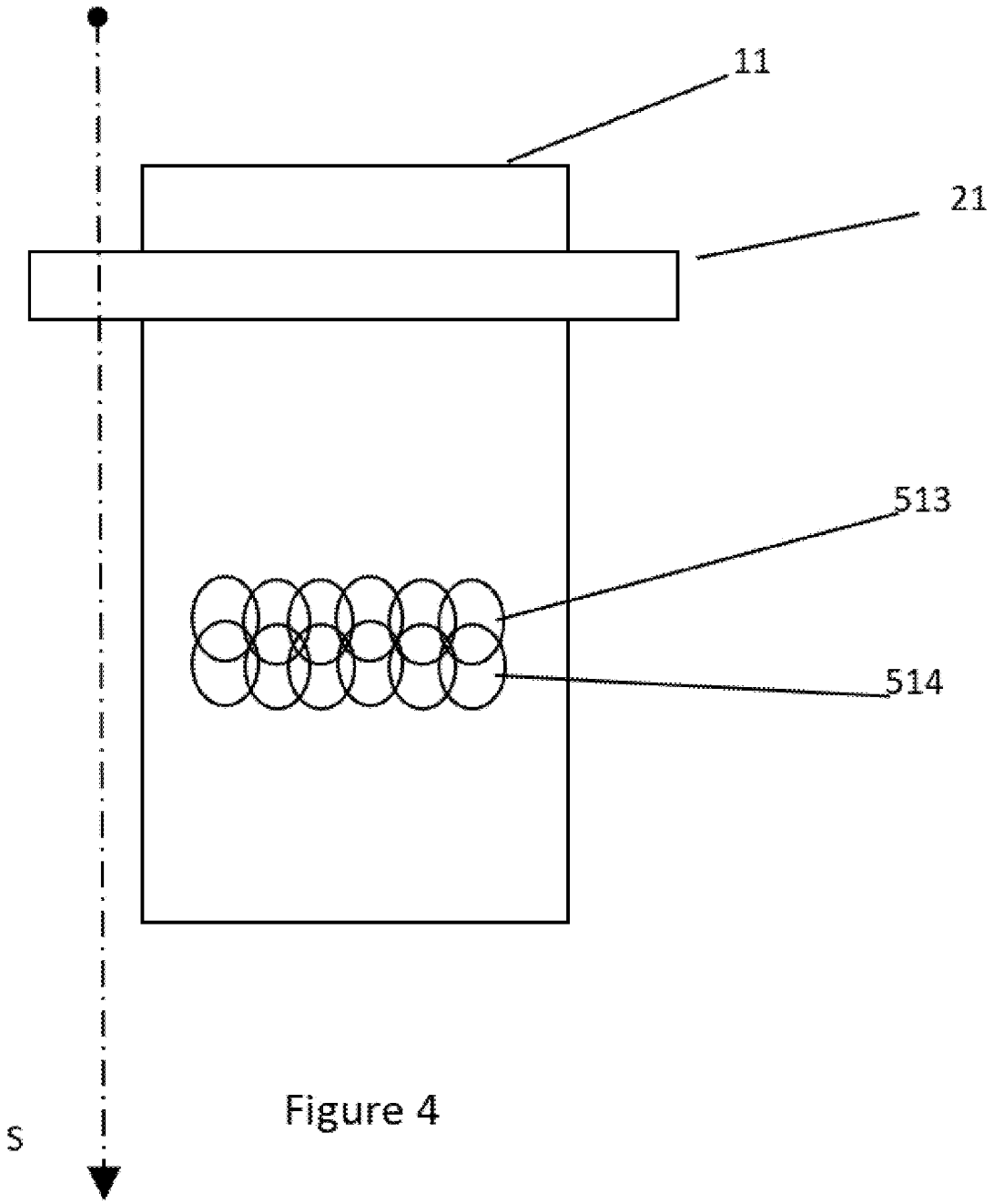
FIG. 4: further top view of a blank passing through a mill in a preferred embodiment of the orientation of the jets of cooling fluid, the jets of cooling fluid upon the first impact thereof on the blank being represented.

In a further preferred embodiment illustrated by a non-limiting example in FIGS. 4 and 13, the top cooling device comprises at least one pair of bars (303 and 304) of nozzles (353, 354), preferentially 3 pairs of bars (303 and 304), in each pair of bars (303 and 304), the jets of cooling fluid (363, 364) being oriented in opposition, the difference $\beta-\alpha/2$ being positive or zero, preferably zero, $\alpha$ being the cone angle of the jet of cooling fluid produced by the nozzles and $\beta$ being the angle of inclination formed by the axis of the nozzles (353, 354) with the line V perpendicular to the top face of the blank (11), the sprayed surfaces (513, 514) of the blank (11) by the jets (363, 364) overlapping preferentially by a factor between ⅓ and ⅔, preferentially ½, and the bottom cooling device comprises at least one bar (40) of nozzles (45), preferentially 8 bars (40), the jets of cooling fluid (46) whereof are conical and of axis substantially normal to the blank (11). Preferably, the blank (11) is substantially horizontal. The angles are represented schematically in the general case in FIG. 5*a* with the nozzles (35), the bars (30) and the jets of cooling fluids (36). FIG. 4 illustrates the sprayed surfaces (51). This configuration is advantageous as it results in the cooling fluid being concentrated in at least a part of the overlap zone of the jets (36) and thus discharging the cooling fluid on the edges with sufficient speed so as not to run onto the edges (1111) of the blank (11), which makes it possible not to overly cool the edges (111) of the blank (11). This makes it possible to reduce the energy consumption of the devices (38) for discharging the cooling fluid or even be able to remove same.

In a further preferred embodiment represented schematically in a non-limiting manner in FIG. 12, the top cooling device comprises at least one bar (30), preferentially 6 bars (30), of nozzles (35) and the bottom cooling device comprises at least one bar (40), preferentially 8 bars (40), of nozzles (45), all producing conical jets of cooling fluid (36) and (46) the axes whereof are substantially perpendicular to the blank (11), and the cone angle $\alpha$ of the jets (36) whereof is less than 20°, preferentially the cone angle $\alpha$ of the jets (36) is substantially 15°. This device has the advantage of being simpler to build. The angle of the conical jets makes it possible to limit the horizontal component of the speed of the cooling fluid upon the impact thereof on the blank (11), and consequently limit the spread of the cooling fluid on the blank (11) to control the cooling thereof.

Figure 14:
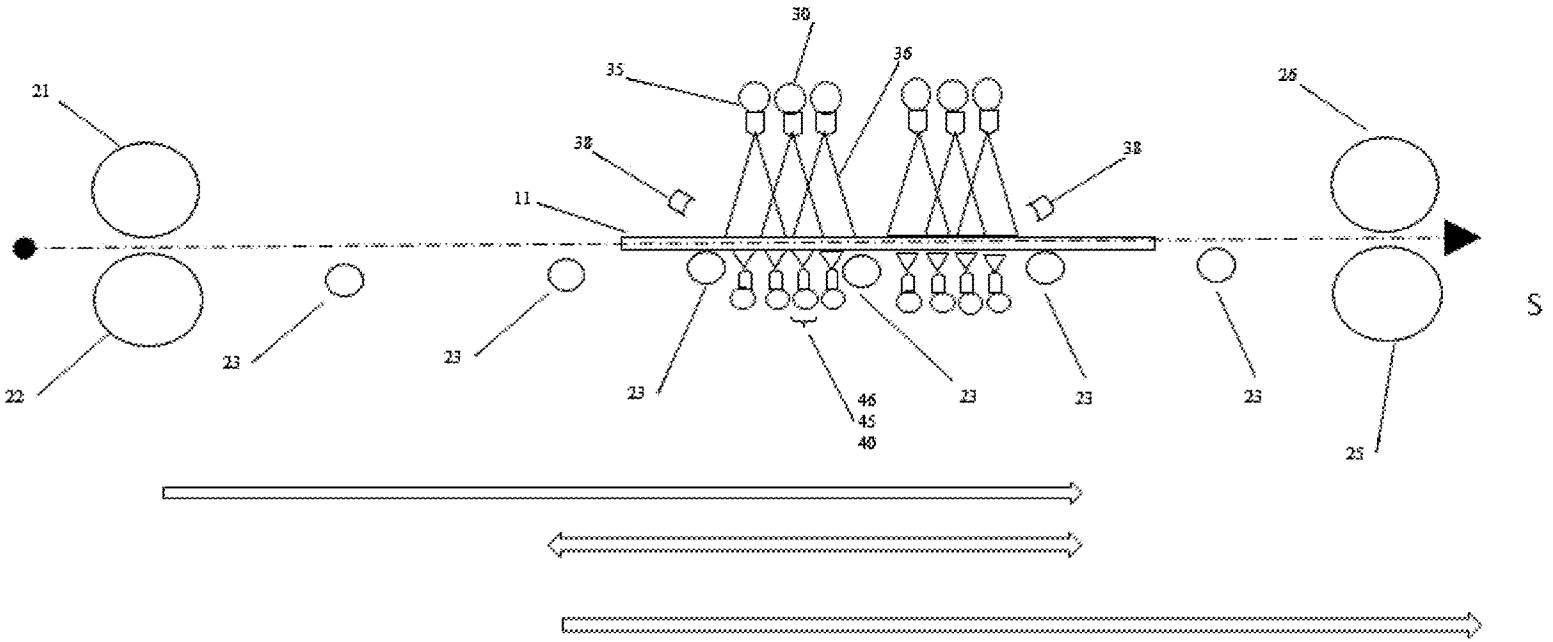
FIG. 14: longitudinal sectional diagram of a further embodiment of a mill according to the invention.

In a further embodiment illustrated in a non-limiting manner by FIG. 14 and FIG. 15, the hot reversing mill according to the invention is part of a hot table wherein the hot reversing mill according to the invention is preferentially followed by a second hot mill, represented schematically with the work rolls (25) and (26) thereof, which can be a reversing mill or a tandem mill. In the embodiment illustrated by FIG. 14, the cooling system of the hot reversing mill according to the invention is positioned between the hot reversing mill according to the invention and the second hot mill, preferentially the distance between the cooling system and the second hot mill being sufficient such that the cooling system according to the invention and the second mill operate independently. This arrangement is advantageous as it makes it possible to carry out the cooling operation in the production flow and with no loss of capacity during the transfer of the blank from the first to the second hot reversing mill. The distance between the cooling system and the second hot mill is also important as, if it is sufficient with respect to the length of the blank, it makes it possible for example to choose different speeds to pass in the cooling system and to pass in the second hot mill. The length of the blank is evaluated by EP*LP/e, where EP is the thickness of the ingot, LP the length of the ingot and e the thickness of the blank between the two mills. In the embodiment illustrated by FIG. 15, there are three cooling systems for the hot reversing mill according to the invention, two systems positioned in the vicinity and at either end of the work rolls (21,22) and one system positioned between the hot reversing mill according to the invention and the second hot mill, preferentially the distance between the cooling system and the second hot mill being sufficient such that the cooling system according to the invention and the second mill operate independently.

The invention also relates to a process for hot rolling aluminum alloys comprising the successive steps of a. providing a rolling ingot made of optionally clad aluminum alloy at a hot rolling input temperature,
b. carrying out a plurality of hot rolling and/or cooling passes with the reversing hot mill according to the invention, the cooling system serving at least once,
c. transferring the blank (11) or the finished product in sheet or strip form at a hot rolling output temperature for the remainder of the hot fabrication process.

The minimum width of the blank (11) can typically take the values of 100 mm, 200 mm, 300 mm, 400 mm, 500 mm, 700 mm, 800 mm, 900 mm, and 1000 mm. The maximum width of the blank (11) can typically take the values of 1500 mm, 2000 mm, 2500 mm, 3000 mm, 3500 mm, 4000 mm, 4500 mm, and 5000 mm.

The minimum thickness of the blank (11) can typically take the values of 5 mm, 6.35 mm, 10 mm, 12 mm, 12.7 mm, 15 mm, 20 mm, 30 mm, 40 mm, 50 mm, 60 mm, 70 mm, 80 mm, 90 mm 100 mm, 110 mm 120 mm, 130 mm, 150 mm, 200 mm, and 250 mm. The maximum width of the blank (11), which typically is similar to that of the cast ingot, can typically take the values of 300 mm, 350 mm, 400 mm, 450 mm, 500 mm, 550 mm, 600 mm, 650 mm, 700 mm, and 800 mm.

The minimum length of the blank (11) can typically take the values of 2 m, 3 m, 4 m, 5 m. The maximum length of the blank (11) can typically take the values of 6 m, 7 m, 8 m, 9 m 10 m, 15 m, 20 m, 30 m, 40 m, 50 m, 75 m, 100 m, 150 m, 200 m, 300 m, 400 m. Two constraints apply to limit the maximum length of the blank (11). The first is the quantity of metal of the rolling ingot before the start of hot rolling. The order of magnitude of the maximum length will be in this case the length of the ingot before the start of the hot rolling divided by the thickness of the blank at the end of the hot rolling multiplied by the thickness of the ingot before the start of the hot rolling. The second limitation of the length of the blank is dependent on the industrial installation wherein the hot mill is installed. By way of non-limiting example, if the industrial installation consists of a hot reversing mill followed by a hot mill in tandem or a second hot reversing mill, the maximum length is set by the distance between the reversing mill according to the invention and the tandem mill or the second hot reversing mill. This implies that all the configurations of lengths, thickness, before and after hot rolling listed above may not all be feasible according to the industrial installation.

The ingot is provided at a hot rolling input temperature. It may have been reheated and/or homogenized.

The hot reversing mill according to the invention carries out a plurality of hot rolling and/or cooling passes with the hot mill. There can therefore be cooling passes without rolling, therefore with no reduction of the thickness of the blank. This function is advantageous as it makes it possible to increase the cooling capacity of the cooling system if required. There can therefore be rolling passes without cooling, but the process according to the invention comprises at least one pass with a cooling with the cooling system according to the invention. The ingot being provided at the hot rolling input temperature, there is preferably no cooling before the first rolling pass. The operations such as cutting the ends, edge trimming, cutting the blank into several smaller blanks, placing the blank on standby, rotating the blank to change the orientation of the hot rolling of the blank (11) or the ingot are routine operations during hot rolling. The examples of the steps mentioned are not limiting. The presence of said routine operations is not an interruption of the hot rolling and does not limit the scope of the invention as they belong to routine hot rolling operations.

The blank is then transferred at a hot rolling output temperature of the reversing mill according to the invention. The hot rolling output temperature is preferably at least 200° C., preferably at least 220° C., preferably at least 240° C. and preferentially at least 260° C. This hot rolling output temperature is a compatible temperature for carrying out a second hot rolling. The blank (11) can be transferred to any routine step on a hot table: hot tandem mill, second hot reversing mill, hot coiling, or hot cutting to length.

Preferentially, the blank comprises an AA6xxx, AA5xxx, AA7xxx, AA3xxx, AA2xxx series aluminum alloy. Preferentially, the blank comprises an alloy chosen from AA3003, AA3004, AA3207, AA3104, AA4017, AA4025, AA5006, AA5052, AA5083, AA5086, AA5088, AA5154, AA5182, AA5251, AA5383, AA5754, AA5844, AA6005, AA6009, AA6013, AA6014, AA6016, AA6022, AA6056, AA6061, AA6111, AA6181, AA6216, AA6316, AA6451, AA6501, AA6502, AA6603, AA6605, AA6607, AA7072 AA7075, and an alloy of composition, as a % by weight, Si<0.5, preferably <0.3, Fe<0.7, preferably <0.3, Mn<1.9, preferably 1-1.5, Cu<1.5, preferably 0.5-1, preferably 0.5-0.8, Ti<0.15, preferably <0.1, Mg<0.5, preferably <0.3, preferably <0.05, the remainder aluminum and unavoidable impurities, 0.05 maximum each and 0.15 the total thereof. Optionally, the blank is clad on one or two faces, with one or more aluminum alloys of the AA1xxx, AA4xxx or AA7xxxx series, and preferentially AA4004, AA4104, AA4045, AA4343, AA7072.

Preferentially, the heterogeneity of the surface temperature of the blank (11) after the release thereof from the roll bite of the mill and the cooling device is less than 20° C. and preferentially less than 10° C. This feature, obtained thanks to the cooling system according to the invention, is useful for enhancing the repeatability of the metallurgical properties of the products. The heterogeneity of the blank (11) is defined as the difference between the temperature of the hottest point of the blank (11) with the temperature of the coldest point of the blank (11) except on the edges (111) and/or except on the ends (112) and alternatively as the difference between the temperature of the hottest point of the blank (11) with the temperature of the coldest point of the blank (11).

With a hot mill which is not equipped with the invention, the edges (111) are naturally colder than the rest of the blank (11) given the heat exchange surface area of the edge (1111). The bottom temperature of the edges (111) is a cause of tears or cracks on the edges which reduce the useful width of the blank or which can cause the fracture thereof. The edges (111) of the blank (11) are therefore preferentially cooled less than the rest of the blank by spraying the edges less than the rest of the blank (11). Preferentially, the nozzles (35) and (45) wherein the jets (36) and (46) could spray the edges (111) are closed so as not to spray said edges (111). FIGS. 11*a* and 11*b* show a non-limiting example with a cross-section along a perpendicular plane to the direction S passing through the top (30) and bottom (40) bars. Some top (35) and bottom (45) nozzles are closed to as not to spray the edges (111).

With a hot mill which is not equipped with the invention, the ends (112) are naturally colder than the rest of the blank (11) given the additional heat exchange surface area at the ends. The bottom temperature of the ends (112) is a cause of refusal of engagement of the blank during hot rolling. With a roll which is equipped with the invention, the ends (112) are therefore preferentially cooled less than the rest of the blank by spraying the ends (112) less than the rest of the blank (11). Preferentially, the nozzles (35) and (45) wherein the jets (36) and (46) could spray the ends (112) are closed during the passage of these ends. This function is preferentially feasible by the individual supply of each nozzle (35) and (45) by a rapid response valve (49) the response time whereof is advantageously less than 1 s, preferentially less than 0.5 s, and more preferentially less than 0.2 s. The rapid response valves (49) are illustrated by the non-limiting example of FIGS. 5*a* and 5*b*. Therefore, in an embodiment, the intersection between the top surfaces (51) sprayed directly with the jets of cooling fluid (36) with the top face of the ends (112) is empty at the start of hot rolling, preferentially for the entire duration of the hot rolling. Therefore, in an embodiment, the intersection between the bottom surfaces (61) sprayed directly by the jets of cooling fluids (46) with the bottom face of the ends (112) is empty at the start of hot rolling, preferentially for the entire duration of the hot rolling.

The cooling fluid is preferentially in calefaction on the blank. Calefaction is a thin layer of vapor that appears between a fluid on a surface the temperature whereof is sufficiently high (Leidenfrost effect). This is advantageous as this ensures a homogeneous heat exchange with respect to the scenario where there are zones of the surface whereon the fluid is not in calefaction.

Preferentially, a thermal model calculates the spraying width and selects the cooling mode at the ends (112), preferentially the thermal model presets the hydraulic system which supplies the bars (30) and (40), then at each pass the thermal model compares the desired temperature with the calculated or measured temperature of the blank (11), and the thermal model controls the valves (49) of the nozzles (35) and (45) according to the position of the blank (11), preferentially the thermal model manages the top (35) and bottom (45) nozzles differently.

Figure 16:
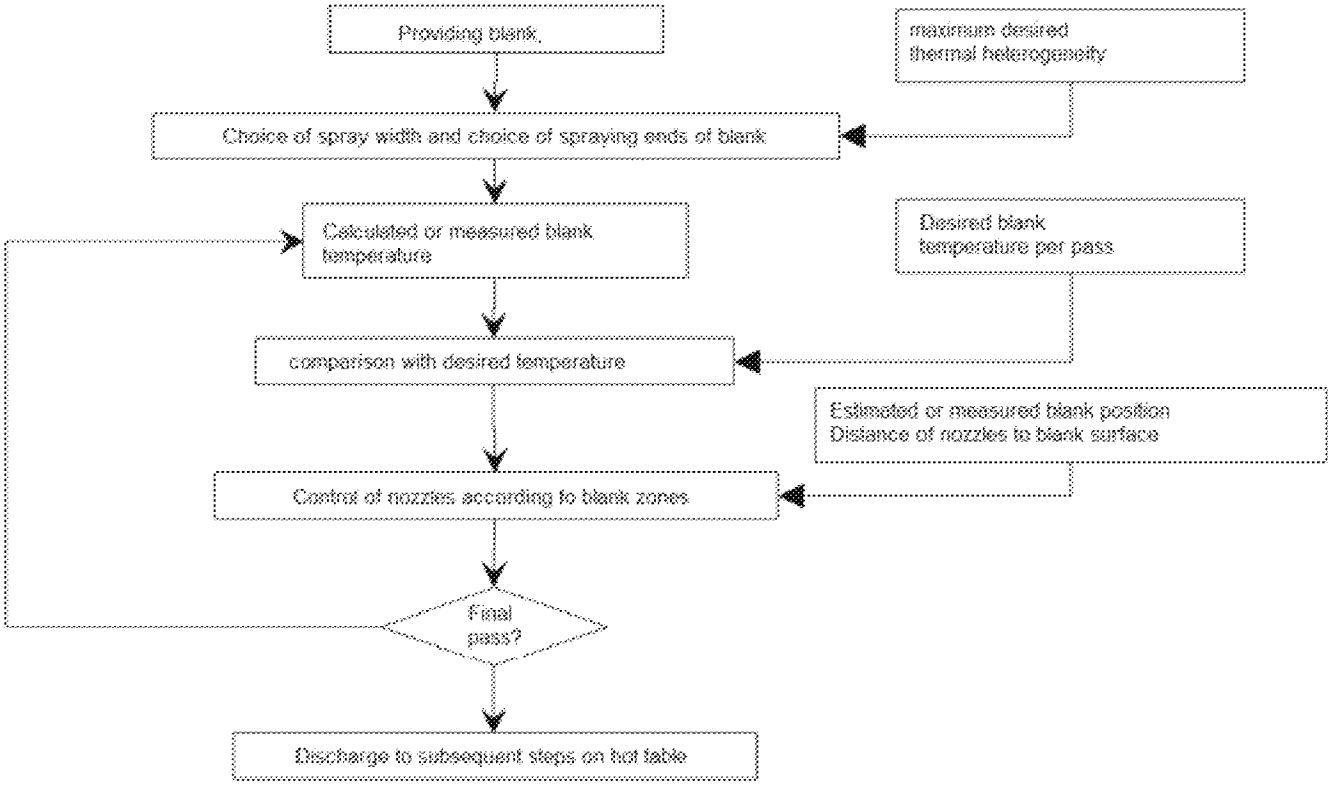
FIG. 16: diagram of the cooling system control principle.

Preferentially, the control principle of the cooling system is as represented schematically in FIG. 16. A thermal model coded on a computer or an automaton calculates the spraying width corresponding to the width of the blank. Preferentially, the spraying width excludes the edges (111) in order to cool same as little as possible to reduce defects such as edge cracks. The thermal model selects the cooling mode at the ends (112). Preferentially, the ends (112) are not sprayed in order to cool same as little as possible to facilitate engagements in the hot mill and reduce the crocodiling phenomenon. Preferentially, the model defines a pre-setting of the hydraulic system which supplies the bars (30) and (40) so that the jets of cooling fluid (36) and (46) are established quickly from the opening the valves (49). Then at each pass, the thermal model compares the desired temperature with the calculated or measured temperature of the blank (11). The measured temperature can be obtained by way of non-limiting example with a contactless infrared pyrometry surface temperature measurement or with a contact measurement on the surface of the blank (11). The calculated temperature can relate to both a surface temperature and a mean temperature. The calculated temperature can be calculated with a thermal simulation software, such as by way of non-limiting example, MSC Marc. With the comparison between the desired temperature and the temperature of the blank (11), the thermal model controls the valves (49) of the nozzles (35) and (45) using the position and the dimensions of the blank (11). The position of the blank (11) can be calculated or measured. In the absence of a blank (11) between the top and bottom devices of the cooling system, the nozzles (35) and (45) are not supplied to prevent, by way of non-limiting example, the jets (46) of the bottom nozzles (45) from spraying the top roll (21) or the jets (36) of the top nozzles (36) from spraying the bottom roll (22). The maximum heterogeneity of the surface temperature of the blank (11), preferentially of the blank (11) except on the edges (111) and/or on the ends (112), after the release thereof from the roll bite of the mill and the cooling device can be less than 20° C. and preferentially less than 10° C. Preferentially, the thermal model manages the top nozzles (35) and the bottom nozzles (45) differently so as to prevent the formation of bridges or boats of the blank (11). Preferentially, the absolute value of the difference in temperature between the top face and the bottom face of the blank (11) is less than 10° C., more preferentially 7° C., more preferentially 5° C., more preferentially 2° C. More preferentially, the temperature of the top face of the blank (11) is substantially equal to the temperature of the bottom face of the blank (11).

The maximum level of temperature heterogeneity of the blank (11) desired with or without the edges (111) and/or the ends (112), the desired temperature are metallurgical choices dependent on the products to be produced. Preferentially, the control of the cooling system is integrated in the control system of the hot reversing mill which controls the rolling parameters.

Preferentially, the thermal device does not cool the surface of the blank (11) below the Leidenfrost temperature of the cooling fluid. The Leidenfrost temperature is the temperature above which the cooling fluid is in calefaction. The Leidenfrost temperature of the cooling liquid prilled on the blank is dependent on the nature of the cooling liquid and the surface flow thereof. The value of this temperature is typically and approximately about 300° C. for the typical cooling fluid, an emulsion and oil and rolling additives, which is less than the usual hot rolling temperatures on a reversing mill. The cooling system can cause substantial temperature heterogeneity between the surface and the core of the blank (11). By spraying the blank (11) for too long or too intensely, the surface temperature of the blank (11) is liable to be momentarily less than the Leidenfrost temperature, which would increase the risk of loss of thermal control in terms of mean value and homogeneity of the blank (11) cooled. The thermal model therefore checks at each pass that the spraying envisaged at the next pass is not at a risk of generating a blank temperature less than the Leidenfrost temperature.

Preferentially, the typical mean cooling rate V of the mean temperature of the blank (11) during the passage of the blank (11) between the top (52) and bottom (62) convex envelopes is of the order of V=C/e, where V is in ° C./s, e is the thickness of the blank in mm, and C is a constant value which equals between 400 and 1000° C./s*mm, preferentially between 600 and 900° C./s*mm, more preferentially between 700 and 800° C./s*mm. The formula V=C/e is an approximation which particularly requires that the surface of the blank (11) remain greater than the Leidenfrost temperature. The mean temperature decrease DT in degrees ° C. of the blank (11) after having traversed the top (52) and bottom (62) convex envelopes of the cooling system is typically of the order DT=C/e*d, d being the passage time of a point of the blank (11) between said convex envelopes, the speed of the blank (11) being constant. This formula is an approximation which particularly requires that the surface of the blank (11) remain greater than the Leidenfrost temperature.

Preferentially, the thickness range of the blank (11) for the application of said formulas has a minimum of 25 mm, preferentially 50, preferentially 75 mm, preferentially 100 mm, preferentially 110 mm and has a maximum of 200 mm, preferentially 175 mm, preferentially 150 mm, preferentially 140 mm, preferentially 130 mm, preferentially 125 mm, preferentially 120 mm.

In a preferred embodiment, the hot rolling cycle time of a blank (11) made of AA6xxx alloy, preferentially of AA6016 alloy, is reduced by at least 30 seconds, preferentially at least 60 seconds, more preferentially at least 90 seconds with the process according to the invention, with respect to rolling without the assistance of said process. In a preferred embodiment, the hot rolling cycle time of a blank (11) made of AA5182 alloy is preferentially reduced by at least 15 seconds, preferentially 20 s, more preferentially 45 s, with respect to rolling without the assistance of said process. The cycle time is the time between the start of the first pass and the end of the final hot rolling pass with the hot reversing mill according to the invention.

In a further preferred embodiment, the cooling system is used preferentially once so as to reduce the mean temperature of the blank by at least 50° C. to a mean temperature greater than 400° C., in less than 10 seconds preferentially in less than 8 seconds for a blank (11) of a thickness of at most 114 mm.

In an embodiment, the cooling system makes it possible to control the temperature of the blank (11) on a predefined thermal path during the hot rolling. The thermal path is the progression of the temperature of the blank (11) for the duration of the hot rolling. The thermal path is a metallurgical choice dependent on the alloy, the desired properties of the finished product, and the capacities of the hot mill.

In a preferred embodiment, the cooling system makes it possible to control the blank (11) on an isothermal thermal path. A thermal path is isothermal if the temperature of the blank (11) during the hot rolling does not vary by plus or minus 10° C. with respect to the temperature of the ingot immediately prior to the start of hot rolling. Preferentially, the temperature of the blank (11) remains substantially equal to the temperature of the ingot before the start of hot rolling.

DETAILED DESCRIPTION OF CERTAIN EMBODIMENTS

In a first embodiment illustrated by FIG. 6, for each cooling system, the top sprayed convex envelope (52) and the bottom sprayed convex envelope (62), are in the vicinity of the rolls of the mill; preferentially the maximum distances D55 and D65 to the rolls (21) and (22) from the sprayed convex envelopes (52) and (62) along the direction S are less than 3 times the largest of the diameters of the work rolls (21) and (22) and/or the lengths D56 and D66 along the direction S of said convex envelopes (52, 62) are less than one diameter of the largest of the work rolls (21) or (22). Preferentially, the convex envelopes (52, 62) are substantially facing. This embodiment is advantageous as it makes it possible to cool the blank (11) from the output thereof from the roll bite of the rolls (21) and (22). This is particularly advantageous as the speed of the hot reversing mills is frequently limited to prevent overheating of the blank (11) which results in burns, cracks, or fractures of the blank (11). This is particularly advantageous as this improves the productivity of the hot mill. Indeed, the speed of the hot reversing mills is frequently limited to prevent overheating which results in burns, or fractures of the blank (11).

In this first embodiment, there is preferentially a second cooling system on the other side of said hot reversing mill of which FIG. 7 is a non-limiting example. The second cooling system is preferentially symmetrical to the first with respect to a plane passing through the axes of the work rolls (21) and (22). This arrangement is advantageous as it makes it possible to cool the blank (11) until the entry thereof into the roll bite and from the output thereof from the roll bite of the reversing mill at each rolling pass, identically.

This system is advantageous as it enables better control of the temperature of the blank during the reversing rolling thereof at each pass, which is beneficial for the metallurgical quality of the product and for the productivity of said reversing mill.

Further non-limiting examples of the first embodiment are given by FIG. 9 and FIG. 10.

In the first preferred embodiment, the hot rolling cycle time of the blank (11) is preferentially reduced by at least 30 seconds for AA6xxx alloys, preferentially for AA6016 alloy, preferentially 60 s, more preferentially 90 s.

In the first preferred embodiment, the hot rolling cycle time of a blank (11) is preferentially reduced by at least 15 seconds for AA5182 alloy, preferentially 20 s, more preferentially 45 s.

A second embodiment is a cooling system suitable for rapidly cooling a blank (11) during a hot rolling.

This embodiment is designed to spray each point of the blank (11) for 10 s, preferentially 8 seconds. Those skilled in the art will be able to adapt the features hereinafter to their specific mill and to the speed of the blank (11).

In a preferred embodiment of the second preferred embodiment, illustrated in a non-limiting manner by FIG. 13, the top cooling device comprises at least one pair of bars (303 and 304) of nozzles (353, 354), preferentially 3 pairs of bars (303 and 304), in each pair of bars (303 and 304), the jets of cooling fluid (363, 364) being oriented in opposition, the difference $\beta-\alpha/2$ being positive or zero, preferably zero, the sprayed surfaces (513, 514) of the blank (11) by the jets (363, 364) overlapping preferentially by a factor between ⅓ and ⅔, preferentially ½, and the bottom cooling device comprising at least 1 bar (40) of nozzles (45), preferentially 8 bars (40), the jets of cooling fluid (46) whereof are conical and of axis substantially normal to the blank (11). The angle $\beta$ formed by the axis of the nozzles (353, 354) with the line V perpendicular to the top face of the blank (11). The angle $\alpha$ is the cone angle of the jet of cooling fluid produced by said nozzles. These angles are represented schematically in FIG. 5*a* with the bars (30), the nozzles (35) and the jets (36). This configuration is of interest as it results in the cooling fluid being concentrated in at least a part of the overlap zone of the jets (36) and thus discharging the cooling fluid on the edges with sufficient speed so as not to run toward the ends of the blank (11), which makes it possible to cool the entire length of the blank uniformly. This system further makes it possible to reduce the energy consumption of the devices (38) for discharging the cooling fluid or even be able to remove same.

In a further preferred embodiment of the second preferred embodiment, illustrated in a non-limiting manner by FIG. 12 or FIG. 14, the top cooling device comprises at least 1 bar (30) of nozzles (35), preferentially 6 bars, and the bottom cooling device comprises at least 1 bar of nozzles (45), preferentially 8 bars, all producing conical jets of cooling fluid (36) and (46) the axes whereof are substantially normal to the blank (11), and the cone angle of the jets (36) whereof is less than 20°, preferentially the cone angle $\alpha$ of the jets (36) is substantially 15°. This device has the advantage of being simpler to build. The angle α of the conical jets of less than 20°, preferentially substantially 15°, makes it possible to limit the horizontal component of the speed of the cooling fluid upon the impact thereof on the blank (11), and consequently limit the runoff of the cooling fluid on the blank (11) to control the cooling thereof.

Figure 19:
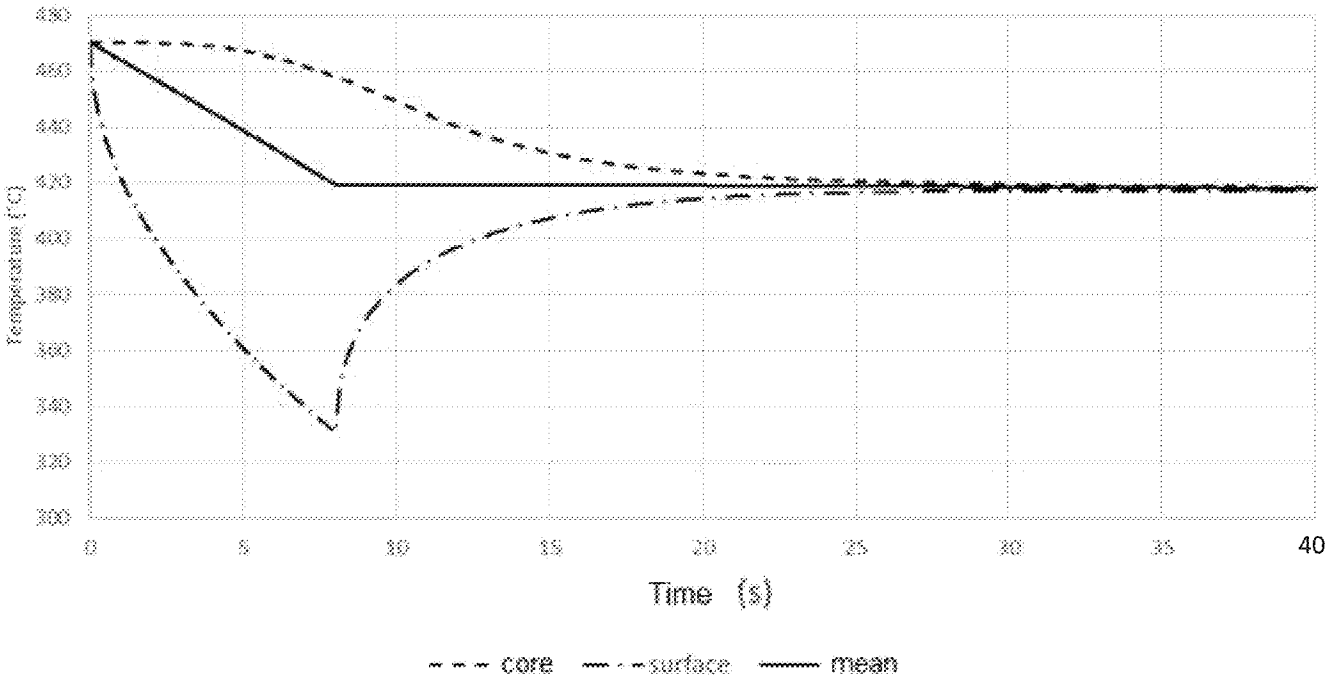
FIG. 19: example of quick cooling of a 114 mm AA6XXX aluminum sheet from 470° C. to 420° C. for 8 s with the hot rolling emulsion with a mill according to the invention according to a further preferred embodiment.

In the second preferred embodiment, the cooling system is used preferentially once so as to reduce the mean temperature of the blank (11) by at least 50° C. to a mean temperature greater than 400° C., in less than 10 seconds preferentially in less than 8 seconds for a blank (11) of a thickness of at most 114 mm as shown in FIG. 19.

In a further embodiment, it is possible to cool the blank (11) more for example by carrying out two passages under the cooling system.

Figure 20:
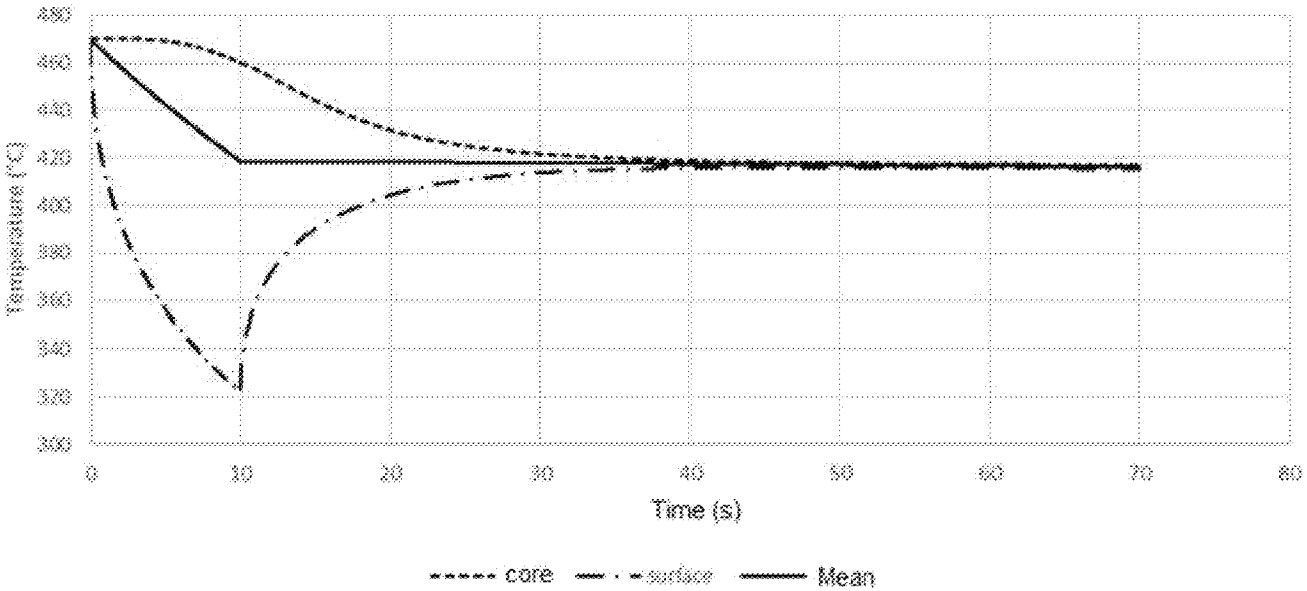
FIG. 20: example of quick cooling of a 140 mm AA6XXX aluminum sheet from 470° C. to 420° C. for 10 s with the hot rolling emulsion with a mill according to the invention according to a further preferred embodiment.

In a further embodiment, it is possible to cool a thicker blank by 50° C. by reducing the passage speed of the blank (11) or by increasing the length of the sprayed surfaces (51) and (61). By way of non-limiting example, a 140 mm blank (11) can be cooled by 50° C. in at least 15 seconds, preferentially at least 10 seconds as shown in FIG. 20.

In a further embodiment, the typical mean cooling rate V of the mean temperature of the blank (11) during the passage of the blank (11) between the top (52) and bottom (62) convex envelopes is of the order of V=C/e, where V is in ° C./s, e is the thickness of the blank in mm, and C is a constant value which equals between 400 and 1000, preferentially between 600 and 900, more preferentially between 700 and 800. The formula V=C/e is an approximation which particularly requires that the surface of the blank (11) remain greater than the Leidenfrost temperature. The mean temperature decrease DT in degrees ° C. of the blank (11) after having traversed the top (52) and bottom (62) convex envelopes of the cooling system is typically of the order DT=C/e*d, d being the passage time of a point of the blank (11) between said convex envelopes, the speed of the blank (11) being constant. This formula is an approximation which particularly requires that the surface of the blank (11) remain greater than the Leidenfrost temperature. Preferentially, the thickness range of the blank (11) for the application of said formulas has a minimum of 25 mm, preferentially 50, preferentially 75 mm, preferentially 100 mm, preferentially 110 mm and has a maximum of 200 mm, preferentially 175 mm, preferentially 150 mm, preferentially 140 mm, preferentially 130 mm, preferentially 125 mm, preferentially 120 mm.

A third preferred embodiment is a process for hot rolling an AA6xxx series aluminum alloy comprising the steps of:

a. casting a rolling ingot made of AA6xxx series alloy,
b. homogenizing the rolling ingot, optionally followed by a reheating,
c. first hot rolling to convert the rolling ingot into a blank having a first output thickness from a first hot rolling starting temperature,
d. cooling the blank obtained with a typical mean cooling rate of the mean temperature of the blank of the order of V=C/e up to a second starting temperature of second hot rolling, where V is in ° C./s, e is the thickness of the blank in mm, and C is a constant which equals between 400 and 1000° C./s*mm, preferentially between 600 and 900° C./s*mm, more preferentially between 700 and 800° C./s*mm,
e. second hot rolling to convert the blank obtained into a strip at the final hot rolling thickness under deformation and temperature conditions such that the strip is recrystallized to at least 50%,
f. cold rolling the strip into a sheet.

The first hot rolling and the cooling are performed preferably with a hot reversing mill according to the invention. During the cooling of step d, the cooling system is preferentially used once so as to reduce preferentially the mean temperature with a typical mean cooling rate of the mean temperature of the blank by at least 50° C. to a mean temperature greater than 400° C. Preferentially, the thickness range of the blank during this cooling has a minimum of 25 mm, preferentially 50, preferentially 75 mm, preferentially 100 mm, preferentially 110 mm and has a maximum of 200 mm, preferentially 175 mm, preferentially 150 mm, preferentially 140 mm, preferentially 130 mm, preferentially 125 mm, preferentially 120 mm.

In an embodiment of the third preferred embodiment, during the cooling of step d, the cooling system is used preferentially once so as to reduce the mean temperature of the blank by at least 50° C. to a mean temperature greater than 400° C., in less than 10 seconds preferentially in less than 8 seconds for a blank (11) of a thickness of at most 114 mm.

The inventors discovered surprisingly that this process makes it possible to enhance productivity while retaining mechanical, surface quality and corrosion resistance properties at least equal to those obtained without the process according to the invention. These products can be particularly useful in the automotive industry in particular for producing external car body components.

In the third preferred embodiment, among the AA6xxx series alloys, the preferred alloys are AA6005, AA6009, AA6013, AA6014, AA6016, AA6022, AA6056, AA6061, AA6111, AA6181, AA6216, AA6316, AA6451, AA6501, AA6502, AA6603, AA6605, AA6607.

In an embodiment of the third preferred embodiment, the composition of the AA6xxx series alloy ingot is an alloy comprising as a % by weight: Si: 0.5-0.8; Mg: 0.3-0.8; Cu: maximum 0.3; Mn: maximum 0.3; Fe maximum 0.5; Ti: maximum 0.15, the remainder aluminum and unavoidable impurities 0.05 maximum each and 0.15 the total thereof, and preferably Si: 0.6-0.75; Mg: 0.5-0.6; Cu: maximum 0.1; Mn maximum 0.1; Fe 0.1-0.25; Ti: maximum 0.05, the remainder aluminum and unavoidable impurities 0.05 maximum each and 0.15 the total thereof.

In a further embodiment of the third preferred embodiment, the composition of the AA6xxx series alloy ingot is an alloy comprising as a % by weight: Si 0.7-1.3; Mg: 0.1-0.8; Cu: maximum 0.3; Mn: maximum 0.3; Fe maximum 0.5; Ti: maximum 0.15, the remainder aluminum and unavoidable impurities 0.05 maximum each and 0.15 the total thereof, and preferably Si: 0.8-1.1; Mg: 0.2-0.6; Cu: maximum 0.1; Mn maximum 0.2; Fe 0.1-0.4; Ti: maximum 0.1, the remainder aluminum and inevitable impurities 0.05 maximum each and 0.15 the total thereof.

After casting, the ingot is preferentially homogenized at a temperature between 500 and 570° C., and preferably between 540 and 560° C. typically for a time of at least 4 hours, and preferably for at least 8 hours. In a preferred embodiment, the maximum homogenizing temperature is at most 555° C. The homogenizing can be in one step or in several steps with increasing temperatures to reduce the risk of incipient melting.

In the third preferred embodiment, the ingot is then rolled into a blank during a first hot rolling on a reversing mill. The rolling starting temperature of the first hot rolling is preferentially greater than 470° C., more preferably above 490° C., and even more preferably above 500° C. Preferably, during this first hot rolling, the temperature is maintained above 450° C., preferably above 470° C. and more preferably above 490° C. Preferably, the first output thickness is between 90 mm and 140 mm, preferentially between 100 and 130 mm, and more preferentially between 110 mm and 120 mm.

This blank thickness is particularly advantageous in factories wherein the hot rolling table consists successively of two hot reversing mills and optionally a hot tandem mill. Indeed, this blank thickness corresponds to the thickness of the blank during the transfer thereof between the first reversing mill and the second reversing mill. Cooling can then be carried out without losing any time.

The blank is then cooled according to a cooling rate of at least 5° C./s from the mean blank temperature to a second starting temperature of second hot rolling. Advantageously, the first hot rolling and the cooling are performed with a hot reversing mill according to the invention, as illustrated particularly by FIGS. 12 to 15.

After cooling, the blank is rolled with a second hot mill into a strip. The second hot rolling can be carried out successively on several hot mills, for example a second hot reversing mill followed by a tandem mill or on the hot reversing mill having been used for the first hot rolling followed by a tandem mill. Preferably, the starting temperature of the second hot rolling is between 380 and 450° C., more preferably between 400 and 440° C., and more preferably between 420 and 435° C. The strip is rolled to a final hot rolling thickness under conditions such that the strip after cooling is recrystallized to at least 50%, preferably at least 80%, and more preferably at least 90%, and particularly preferentially at least 98%. A recrystallization of at least respectively 50%, 80%, 90% and 98% means that the recrystallization rate measured through the thickness and in at least 3 points of the width is respectively at least 50%, 80%, 90% and 98%. Typically, the recrystallization varies through the thickness and can be complete on the surface and incomplete at mid-thickness. The preferred recrystallization rate is dependent on the alloy of the strip.

To obtain said recrystallization, it is advantageous that the output temperature of the second hot rolling be at least 345° C., preferably at least 350° C. and more preferentially at least 355° C. The reduction in thickness during the final pass of the second rolling is a parameter to ensure recrystallization. Said reduction of the final pass of the second hot rolling is at least 25%, preferentially at least 30%, preferentially 40%, and more preferentially at least 45%. The typical thickness of the strip obtained with the second hot rolling is between 4 and 10 mm.

The strip is then cold rolled into a sheet. With the method according to the invention, it is not necessary to perform an annealing and/or a solution heat treatment between the hot rolling and the cold rolling or during cold rolling to obtain mechanical, formability, surface condition or corrosion properties. Preferably, an annealing and/or a solution heat treatment is not carried out between the hot rolling and the cold rolling or during cold rolling. The sheet has a thickness typically between 0.5 and 2 mm. In a preferred embodiment, the reduction by cold rolling is between 70% and 80%. In a further preferred embodiment, the reduction rate between the strip and the sheet is at least 80% to obtain the most advantageous surface quality.

Preferentially, after step f, an additional step can be carried out g: solution heat treatment and quenching of the sheet thus obtained in a continuous heat treat furnace.

Said continuous heat treat furnace operates preferentially such that the equivalent hold time at 560° C., $$t_{eq}^{560°},$$

is less than 30 s, preferably less than 25 s and more preferably less than 20 s, the equivalent hold time being calculated using the equation $$t_{eq}^{560°} = \int_{time\ in\ furnace} \exp\left[-\frac{Q}{R}\cdot\left(\frac{1}{T^{\circ}C\cdot(t)+273} - \frac{1}{560+273}\right)\right]\cdot dt$$

Q being an activation energy of 200 KJ/mol and R=8.314 J/mol/K

Preferentially, after the solution heat treatment and the quenching, a pre-ageing is optionally performed, and the sheet ages at ambient temperature, so as to attain the temper T4, is cut out and formed until the final shape thereof is obtained, is painted, and hardened by curing The sheet, after solution heat treatment in a continuous heat treat furnace operating such that the equivalent hold time at 560° C., $t_{eq}^{560°}$, is less than 20 s, the equivalent hold time being calculated using the equation $$t_{eq}^{560°} = \int_{time\ in\ furnace} \exp\left[-\frac{Q}{R}\cdot\left(\frac{1}{T^{\circ}C\cdot(t)+273} - \frac{1}{560+273}\right)\right]\cdot dt$$

Q being an activation energy of 200 KJ/mol and R=8.314 J/mol/K, attains a tensile strength of at least 90% and preferably at least 95% of the maximum tensile strength obtained after solution heat treatment with an equivalent hold time at 560° C., $$t_{eq}^{560°}$$

of 98 s.

The sheet obtained from the cold rolling is particularly advantageous if only because it is easy to treat by solution heat treatment. Conventional procedures aimed at obtaining a satisfactory surface condition, compatible with a quality for external car body sheets, generally include an additional heat treatment during the fabrication procedure with respect to the sheet obtained according to the invention. The presence of this additional heat treatment means that those skilled in the art need to use high temperatures and substantial equivalent hold times on the solution heat treatment lines with continuous annealing in order to obtain sufficiently high mechanical strengths in the tempers as supplied and after curing the paints. On the contrary, the cold-rolled sheet according to the invention can use a solution heat treatment in a continuous annealing line operating such that the equivalent hold time at 560° C., $t_{eq}^{560°}$, is short, typically less than 25 s, the equivalent hold time being calculated using the equation $$t_{eq}^{560°} = \int_{time\ in\ furnace} \exp\left[-\frac{Q}{R}\cdot\left(\frac{1}{T^{\circ}C\cdot(t)+273} - \frac{1}{560+273}\right)\right]\cdot dt$$

Q being an activation energy of 200 KJ/mol and R=8.314 J/mol/K.

Generally, the continuous annealing line operates such that the heating rate of the sheet is greater than or equal to 10° C./s for a metal temperature less than 400° C., the time spent at over 530° C. is between 15 s and 90 s, and the quench rate is greater than or equal to 10° C./s, preferably greater than or equal to 15° C./s for a thickness of 0.9 to 1.1 mm. The solution heat treatment ensures that the metal reaches a temperature below but close to the solidus temperature, that is to say generally greater than 530° C. and less than 570° C. The coiling temperature after the solution heat treatment is preferably between 50° C. and 90° C., and preferably between 60° C. and 80° C.

After the solution heat treatment and the quenching, the sheet can age so as to attain the temper T4, before being cut out and formed until the final geometry thereof is obtained, painted, and hardened by curing.

The process according to the invention is particularly useful for manufacturing sheets intended for the automotive industry which combine a high tensile yield strength and a formability suitable for cold drawing operations, as well as an excellent component surface quality and a high corrosion resistance with a high productivity.

In a fourth preferred embodiment, the hot mill combines the first preferred embodiment and the second embodiment.

A non-limiting example is given in FIG. 15. The hot mill is surrounded by cooling systems which make it possible to enhance the productivity thereof. A third cooling system makes it possible to perform a rapid cooling during the transfer to the subsequent hot rolling. This fourth embodiment makes it possible to combine the gain in productivity on the hot reversing mill, the rapid cooling with no impact on productivity during the transfer to the subsequent rolling, the whole making it possible to supply AA6xxx alloy sheets with satisfactory surface quality and enhancing the productivity of the solution heat treatment and quenching lines.

EXAMPLES

Example 1

A hot reversing mill according to the invention illustrated by FIG. 7 comprises two cooling systems installed symmetrically on either side of work cylinders. Each of these two cooling systems is composed of a top cooling device and a bottom cooling device. The top cooling device includes a bar (30) of nozzles (35) oriented toward the roll (21). Each top bar of nozzles is protected by a protective component (37). The bottom cooling device includes two bottom bars (40) of nozzles (45) installed below the plane of the axes of the reels (23); a first bar (40) between the first reels (23) from the roll (22) and the second reel (23), and the second bar (40) of nozzles (45) between the second and the third reel (23). The reels (23) are close enough not to require the installation of a protective component (47). The nozzles (35) and (45) produce solid conical jets by prilling. The nozzles (45) produce conical jets which are almost tangent to the reels (23). The nozzles (35) and (45) are supplied by rapid response valves the response time whereof is 0.2 s. The convex envelope of the top sprayed surface is substantially facing the convex envelope of the bottom sprayed surface. Said convex envelopes are less than 3 diameters of the largest of the two work rolls of the hot reversing mill. The mean surface flow by surface area is about 1200 l/min/m$^2$. The cooling fluid is the emulsion of the mill used to lubricate the blank (11) during the hot rolling thereof. The cooling fluid is in calefaction on the surface of the blank (11).

Figure 18:
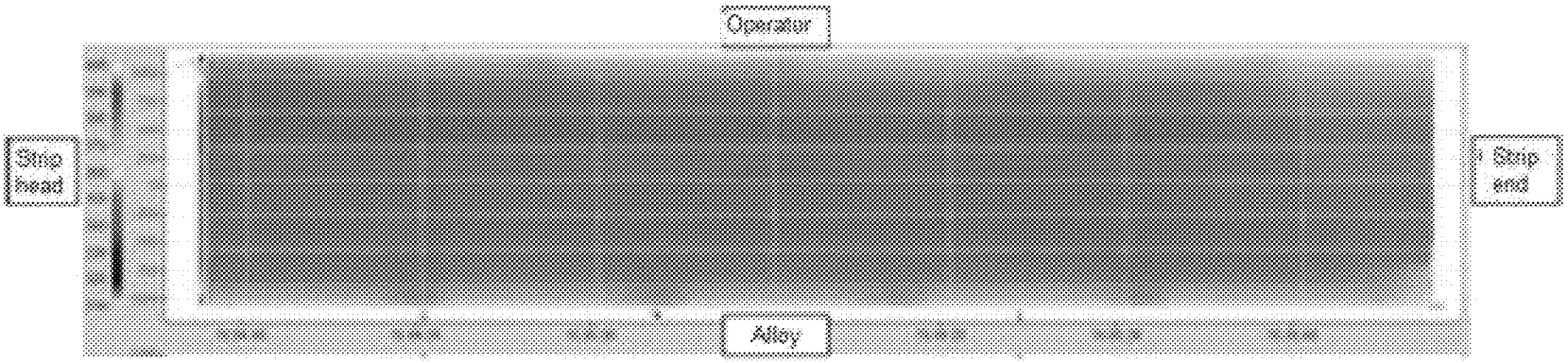
FIG. 18: example of the temperature heterogeneity of the blank using the mill according to the invention according to a preferred embodiment.

A 500 mm thick ingot was hot-rolled with a cooling according to the invention at each hot rolling pass. FIG. 18 shows the thermal field on the top surface of a blank made of AA6016 alloy having the dimensions 2000 mm wide, 50 mm thick, and 5000 mm long, just at the output of the final hot reversing rolling pass. The heterogeneity of the surface temperature of the blank, including the edges and the ends, is 10° C. both lengthwise and widthwise.

Figure 17:
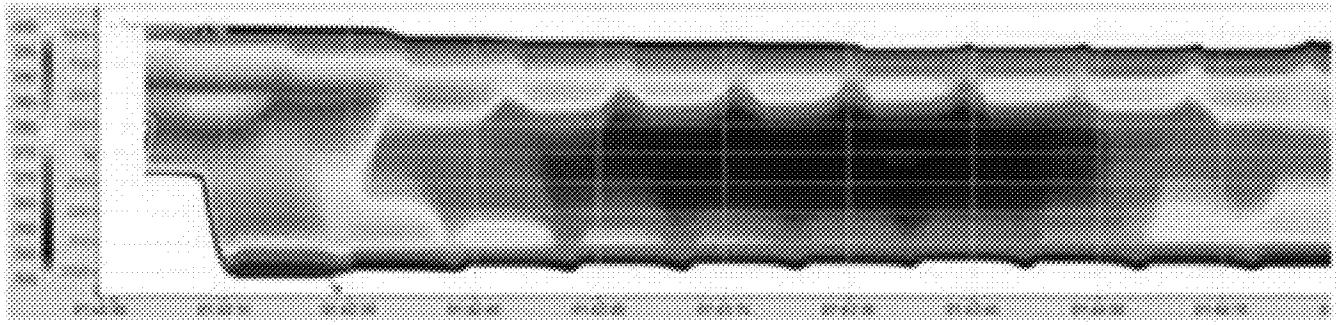
FIG. 17: example of the temperature heterogeneity of the blank for a process according to the prior art.

An identical ingot of the same alloy was also hot-rolled but without the use of a cooling system according to the invention. FIG. 17 shows the thermal field on the top surface of the blank obtained having the same dimensions as that shown in FIG. 18 just at the output of the final hot reversing rolling pass. The heterogeneity of the surface temperature of the blank is 25° C. both lengthwise and widthwise in the absence of the use of the cooling system according to the invention.

In addition to the noteworthy improvement of the thermal uniformity of the blank using the invention with respect to practice without using the invention, the cooling of the blank during the rolling procedure makes it possible to reduce the hot reversing rolling cycle time by 90 seconds.

Two ingots made of AA5182 alloy, 1480 mm wide and 510 mm thick, were hot-rolled with the invention, the first with the invention and the second without the invention. The hot rolling cycle time of the first ingot was 64 s shorter compared to the second.

Example 2

A hot mill according to the invention comprising work rolls (21,22) and a cooling system having six top bars (30) of nozzles (35) and eight bottom bars (40) of nozzles (45) is represented in FIG. 14. It is part of a hot table comprising a second reversing mill comprising work rolls (25,26). These two hot reversing rolls are part of a hot table including additionally a hot tandem mill. The nozzles of the top bars (35) are oriented perpendicularly to the plane of the blank (11). The jets of the top nozzles (36) are solid conical, the cone angle whereof is substantially 15°. The cooling fluid is the emulsion serving for the lubrication of the work rolls during the hot rolling. The nozzles (45) of the bottom bars (40) are oriented perpendicularly to the bottom face of the blank (11). The jets of the bottom nozzles are solid conical, the cone angle whereof is substantially 90°. The sprayed surfaces (52) and (62) are substantially facing.

The system is capable of cooling a 114 mm thick sheet from a temperature of 470° C. to a mean temperature of 420° C. in 8 seconds as shown on the graph in FIG. 19 obtained by digital simulation. 20 seconds after the start of cooling, the heterogeneity in the thickness of the blank is about 9° C., and 30 s after the start of cooling, the heterogeneity in the thickness of the blank is about 2° C. In table 1, examples D and E, which are 114 and 109 mm blanks of AA6xxx series alloy, were cooled with the system without particular adjustment to obtain hot edges or ends. The temperatures mentioned in table 1 are measurements made on the surface of the blanks. In view of the transfer times greater than 30 s between the first hot reversing mill and the cooling system and between the cooling system and the second hot reversing mill, the surface temperatures of blanks D and E are representative of the mean temperature of said blanks as well as the core temperatures. Sheets D and E were therefore cooled by 57 and 75° C.

TABLE 1

| | A Reference example A | B Reference example B | C Reference example C | D Example D according to the invention- | E Example E according to the invention- |
|---|---|---|---|---|---|
| Composition (% by weight) | | | | | |
| Si | 0.66 | 0.67 | 0.70 | 0.69 | 0.69 |
| Fe | 0.14 | 0.15 | 0.14 | 0.15 | 0.15 |
| Cu | 0.01 | 0.01 | 0.01 | 0.01 | 0.01 |
| Mn | 0.08 | 0.07 | 0.09 | 0.07 | 0.07 |
| Mg | 0.64 | 0.64 | 0.52 | 0.54 | 0.56 |
| Cr | 0.01 | 0.01 | 0.01 | 0.01 | 0.01 |
| Ti | 0.03 | 0.04 | 0.05 | 0.05 | 0.04 |
| Ingot heat treatment | | | | | |
| homogenizing | 6.5 h 554° C. | 6.7 h 554° C. | 30 h 554° C. | 20 h 554° C. | 16 h 554° C. |
| cooling | N/A | N/A | ambient temperature | N/A | N/A |
| reheating | N/A | N/A | at rolling temperature | N/A | N/A |
| First hot rolling | | | | | |
| rolling starting temperature (° C.) | 554 | 553 | 393 | 511 | 537 |
| Final thickness (mm) | 114 | 114 | 114 | 114 | 109 |
| rolling end temperature (° C.) | 524 | 523 | 360 | 481 | 507 |
| cooling | | | | | |
| cooling rate | N/A | N/A | N/A | 5° C./s | 5° C./s |
| second hot rolling | | | | | |
| rolling starting temperature (° C.) | 519 | 519 | 356 | 424 | 432 |
| Final hot rolling thickness (mm) | 3.05 | 3.05 | 6.35 | 5.08 | 5.08 |
| reduction at final hot pass | 41% | 39% | 44% | 47% | 47% |
| coiling temperature (° C.) | 332 | 327 | 343 | 352 | 357 |
| Cold roll | | | | | |
| cold reduction (%) | 73.7 | 73.8 | 85.0 | 81.3 | 81.3 |
| final thickness (mm) | 0.8 | 0.8 | 0.95 | 0.95 | 0.95 |

Five ingots, the compositions whereof are given in table 1 as a % by weight, were cast. Table 1 also details the fabrication process. Columns A and B describe an ingot and the fabrication steps thereof into a blank then into a strip then into a sheet to produce internal car body elements which have no requirements in terms of surface quality. Column C describes an ingot and the typical fabrication steps thereof into a blank then into a strip then into a sheet to produce external car body elements which have substantial requirements in terms of surface quality. These are reference examples wherein cooling is not carried out during the hot rolling. Columns D and E are examples of the invention.

The 5 ingots A, B C D and E were homogenized with the conditions of table 1. Ingots A, B, D and E were transferred to the first hot reversing rolling. Ingot C was cooled to ambient temperature then reheated to the starting temperature of the first hot rolling and transferred to the first hot reversing rolling. The 5 ingots were hot-rolled by the first hot mill into a 114 mm thick blank except ingot E which was rolled into a 109 mm thick blank. The 5 blanks were then transferred to the second hot reversing mill through the cooling system of the first hot mill. Blanks A, B and C passed through the cooling system without being sprayed, and only underwent natural air cooling during the transfer thereof to the second hot reversing mill. Blanks D and E passed through the cooling system in operation and were therefore cooled to the surface temperature indicated in table 1. The 5 blanks were then rolled with the second hot reversing mill, then with a hot tandem mill into a strip. On leaving the hot tandem mill, the strips were coiled according to the characteristics in table 1. After cooling, the 5 coils were cold-rolled into sheets.

Figure 25:
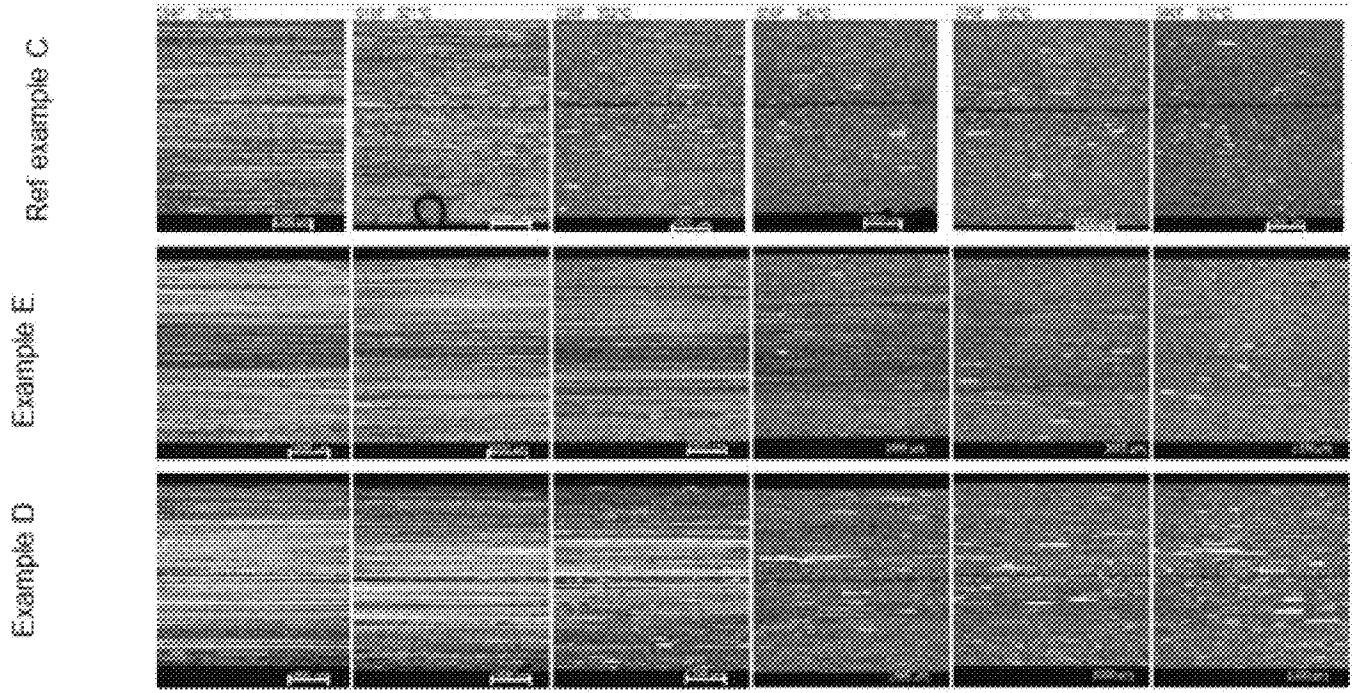
FIG. 25: metallographs showing the recrystallization rate under different conditions

Samples from strips C, D and E were taken after the final hot rolling pass and before coiling. These samples were cooled quickly by immersing them in a water tank at ambient temperature. Then recrystallization kinetics were carried out in a laboratory by heating each sample to different temperatures, then the samples are cooled similarly to the cooling of a coil after hot rolling. Metallographs were then produced (FIG. 25) and the recrystallization rate evaluated (tableau 2).

TABLE 2

| | | Heating temperature | | | | | |
|---|---|---|---|---|---|---|---|
| | | 310° C. | 321° C. | 332° C. | 343° C. | 355° C. | 365° C. |
| C | Ref example | 0% | 75% | 98% | 100% | 100% | 100% |
| D | invention | 0% | 15% | 33% | 44% | 95% | 100% |
| E | invention | 0% | 6% | 43% | 94% | 99% | 100% |

The roping surface condition quality was characterized on sheets A, B, D and E. The roping is measured as follows. A sample measuring about 270 mm (in the transversal direction to the rolling direction) by 50 mm (in the rolling direction) is cut out from the sheet. A tensile pre-deformation of 15%, perpendicular to the rolling direction, i.e. in the direction of the length of the sample, is then applied. The sample is then subjected to the action of a P800 type sandpaper in order to reveal the roping.

Figure 21:
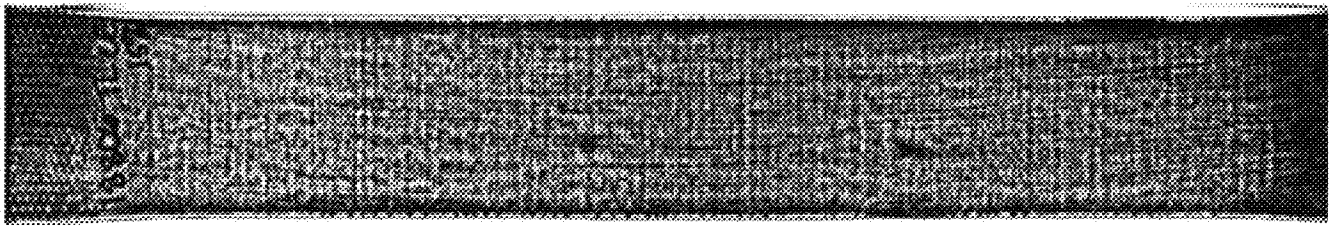
FIG. 21: photo of the "roping" surface quality without the invention as described in example A.
Figure 22:
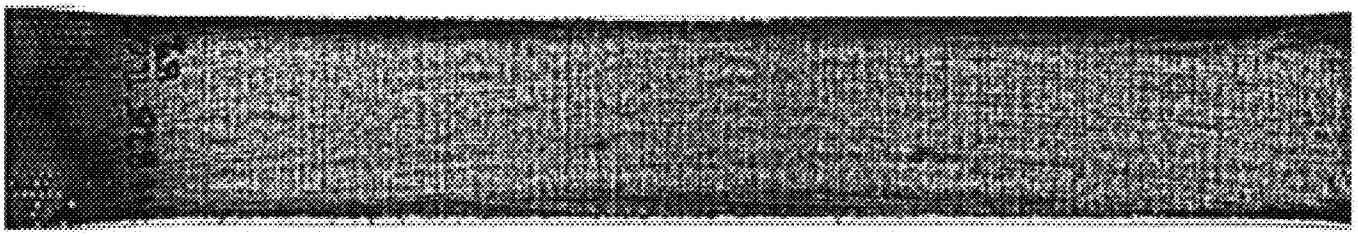
FIG. 22: photo of the "roping" surface quality without the invention as described in example B.
Figure 23:
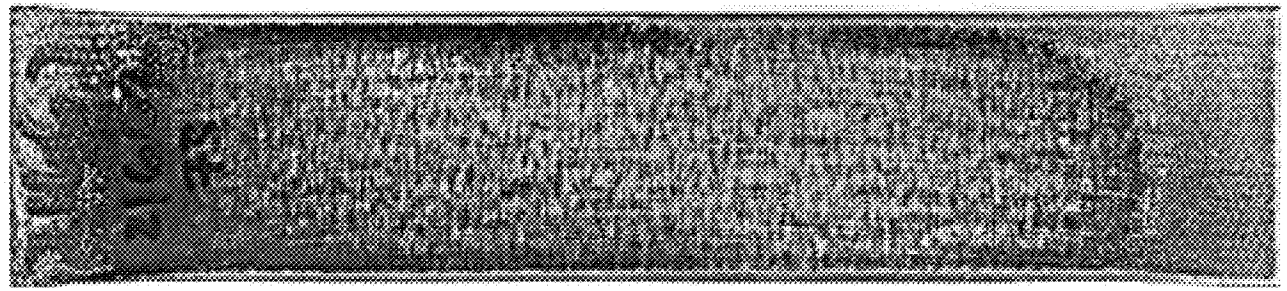
FIG. 23: photo of the "roping" surface quality with the invention as described in example D.
Figure 24:
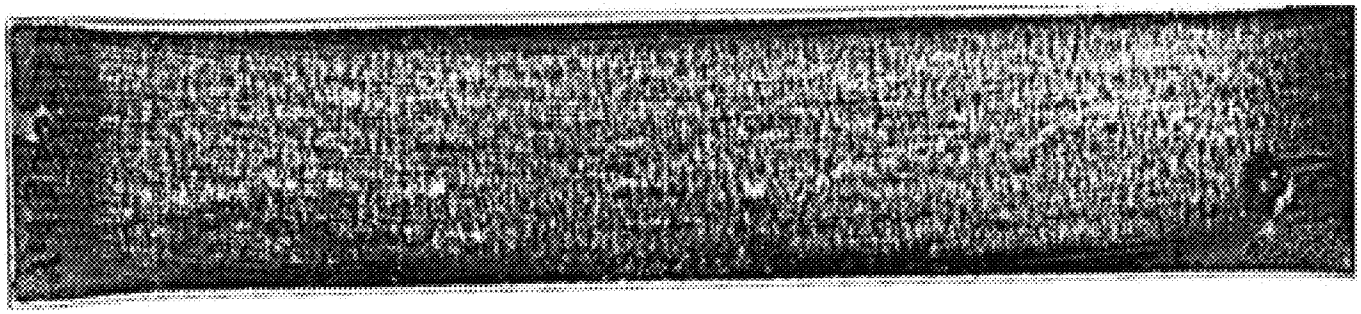
FIG. 24: photo of the "roping" surface quality with the invention as described in example E.

Sheets D and E, produced according to the invention, have a compliant surface quality for producing external car body elements as shown in FIG. 23 for sheet D and FIG. 24 for sheet E. This is not the case of sheets A and B as shown in FIG. 21 for sheet A and FIG. 22 for sheet B. The cooling system demonstrates the usefulness thereof for obtaining the surface quality with a more economical process by removing the reheating as for sheet C, not characterized specifically in surface quality, which serves to produce external car body elements.

To evaluate the solution heat treatment kinetics of the 3 sheets C, D and E, the following characterizations were conducted. Samples were taken after cold rolling to the final thickness on the 3 sheets C, D and E. Various solution heat treatments were first performed on the samples by varying the solution heat treatment times of the samples in a fluidized bed furnace at 570° C. A long immersion period of 90 s at 570° C. was used for the complete solution heat treatment of the samples. The time of 90 s at 570° C. is equivalent to a time of 98 s at 560° C. using the formula $$t_{eq}^{560^\circ} = \int_{time\ in\ furnace} \exp\left[-\frac{Q}{R}\cdot\left(\frac{1}{T^{\circ C.}(t)+273} - \frac{1}{560+273}\right)\right]\cdot dt$$

Q being an activation energy of 200 KJ/mol and R=8.314 J/mol/K.

Shorter solution heat treatment times in the fluidized bed furnace at 570° C. were used to obtain an incomplete solution heat treatment of the alloys. These solution heat treatments were all followed by a water quenching to 80° C. and a pre-ageing treatment of 8 hours at 80° C. After these different solution heat treatments, followed by quenching then pre-ageing, the samples were annealed for 2 hours at 205° C. in an oil bath in order to attain the temper T6.

Tensile tests were then performed. The yield strength (Rp0.2) obtained after the final annealing treatment in the temper T6 is used an indicator of the solution heat treatment quality of the samples. Indeed, according to the precipitation state existing in the sheets, the solution heat treatment time at the solution heat treatment temperature (herein 570° C.) required to dissolve these precipitates varies. For productivity reasons on the production machines carrying out the solution heat treatment, it is advantageous that the solution heat treatment time be as short as possible.

Figure 26:
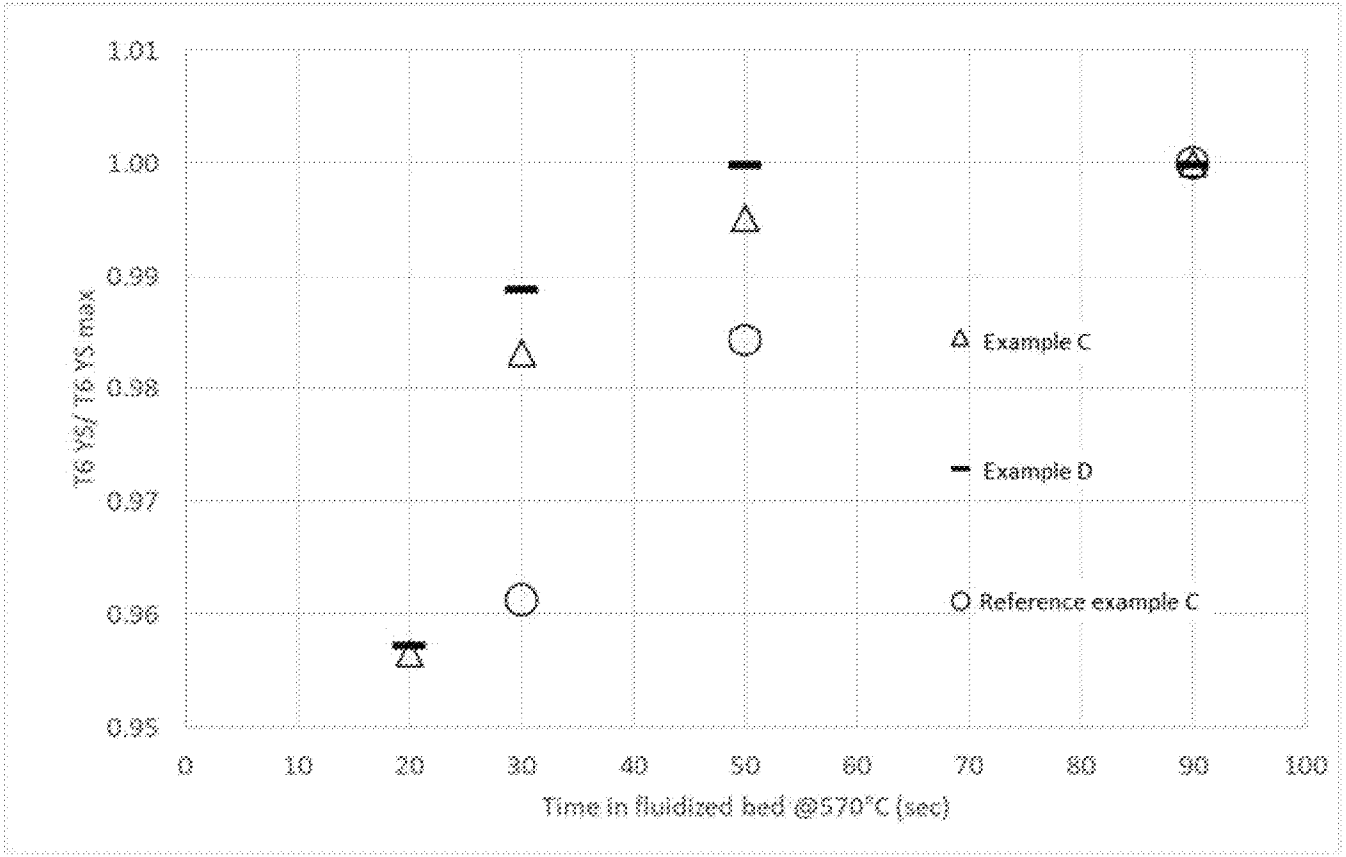
FIG. 26: graph showing the effect of the solution heat treatment time on a mechanical property

The results of the tensile tests of the 3 sheets C, D and E are indicated in table 3 and in FIG. 26. On this graph, each yield strength measured (T6YS) is normalized with the yield strength obtained for the same sheet after a solution heat treatment time of 90 seconds in the fluidized bed at 570° C. (T6YSmax).

FIG. 26 shows that the solution heat treatment kinetics of the two sheets D and E according to the invention are much more rapid than those of the comparative example C. Indeed, after immersing for 50 s in the fluidized bed at 570° C., the yield strength in the temper T6 of examples D and E according to the invention attained more than 99% of the maximum yield strength thereof in the temper T6, whereas the comparative example C is just above 98% of the maximum yield strength thereof in the temper T6. Similarly, after a solution heat treatment of 30 s in the fluidized bed at 570° C., the yield strength in the temper T6 of examples D and E according to the invention attained more than 98% of the maximum yield strength thereof in the temper T6, whereas the comparative example C is 96% of the maximum yield strength thereof in the temper T6. Therefore, the invention furthermore makes it possible to accelerate the productivity of the solution heat treatment.

TABLE 3

| | | Immersion time in fluidized bed (s) at 570° C. | yield strength (T6YS – MPa) | Yield strength in temper T6 divided by the maximum yield strength in temper T6 (T6YS/T6YS max) |
|---|---|---|---|---|
| D | invention 1 | 10 | 143 | 0.52 |
| D | invention 1 | 20 | 264 | 0.96 |
| D | invention 1 | 30 | 271 | 0.98 |
| D | invention 1 | 50 | 275 | 1.00 |
| D | invention 1 | 90 | 276 | 1.00 |
| E | Invention 2 | 10 | 134 | 0.49 |
| E | Invention 2 | 20 | 262 | 0.96 |
| E | Invention 2 | 30 | 271 | 0.99 |
| E | Invention 2 | 50 | 274 | 1.00 |
| E | Invention 2 | 90 | 274 | 1.00 |
| C | ref example 3 | 30 | 264 | 0.96 |
| C | ref example 3 | 50 | 271 | 0.98 |
| C | ref example 3 | 90 | 275 | 1.00 |

The invention claimed is:

1. A process for hot rolling an AA6xxx series aluminum alloy, comprising:

a. casting a rolling ingot made of AA6xxx series alloy, b. homogenizing the rolling ingot, optionally followed by a reheating, c. first hot rolling to convert the rolling ingot into a blank having a first output thickness from a first hot rolling starting temperature, d. cooling the blank obtained with a mean cooling rate of the mean temperature of the blank of V=C/e up to a second starting temperature of second hot rolling, where V is in ° C./s, e is the thickness of the blank in mm, and C is a constant which equals between 40° and 1000° C./s*mm, optionally between 600 and 900° C./s*mm, or optionally between 70° and 800° C./s*mm, e. second hot rolling to convert the blank obtained into a strip at the final hot rolling thickness under deformation and temperature conditions such that the strip is recrystallized to at least 50%, f. cold rolling the strip into a sheet.

2. The process according to claim 1, wherein the first hot rolling and the cooling are performed with a hot mill and/or during cooling of step d, a cooling system is used optionally once so as to reduce mean temperature of the blank by at least 50° C. to a mean temperature greater than 400° C.

3. The process according to claim 1, wherein the temperature during the first hot rolling is maintained above 450° C., optionally above 470° C. and optionally above 490° C. and/or the first output thickness is between 90 mm and 140 mm, optionally between 100 and 130 mm, and optionally between 110 mm and 120 mm and/or the output temperature of the second hot rolling is at least 345° C., optionally at least 350° C. and optionally at least 355° C. and/or the reduction of the final pass of the second hot rolling is at least 25%, optionally at least 30%, optionally 40%, and optionally at least 45% and/or the reduction by cold rolling is between 70% and 80%, or greater than 80%.

4. The process according to claim 1, wherein after step f, further comprising g. solution heat treatment and quenching of the sheet thus obtained in a continuous heat treat furnace, optionally the continuous heat treat furnace operates such that equivalent hold time at 560° C., $t_{eq}^{560°}$ is less than 30 s, optionally less than 25 s and optionally less than 20 s, equivalent hold time being calculated using equation $$t_{eq}^{560°} = \int_{time\ in\ furnace} \exp\left[-\frac{Q}{R}\cdot\left(\frac{1}{T^{\circ C.}(t)+273} - \frac{1}{560+273}\right)\right]\cdot dt$$

Q being an activation energy of 200 KJ/mol and R=8.314 J/mol/K.

5. The process according to claim 4, wherein after the solution heat treatment and the quenching, a pre-ageing is optionally performed, and the sheet ages at ambient temperature, so as to attain temper T4, the sheet is cut out and formed until a final shape thereof is obtained, the final shape is painted and the painted final shape is hardened by curing.

6. The process according to claim 1, wherein the AA6xxx series alloy is selected from the group consisting of AA6005, AA6009, AA6013, AA6014, AA6016, AA6022, AA6056, AA6061, AA6111, AA6181, AA6216, AA6316, AA6451, AA6501, AA6502, AA6603, AA6605, and AA6607.

7. The process according to claim 1, wherein the AA6xxx series alloy comprises, by weight %, Si: 0.5-0.8;
Mg: 0.3-0.8;
Cu: maximum 0.3;
Mn: maximum 0.3;
Fe maximum 0.5;
Ti: maximum 0.15,
the remainder aluminum and unavoidable impurities 0.05 maximum each and 0.15 in total.

8. The process according to claim 1, wherein the AA6xxx series alloy comprises, by weight %, Si 0.7-1.3;
Mg: 0.1-0.8;
Cu: maximum 0.3;
Mn: maximum 0.3;
Fe maximum 0.5;
Ti: maximum 0.15,
the remainder aluminum and unavoidable impurities 0.05 maximum each and 0.15 in total.

* * * * *